US006439957B1

(12) United States Patent
MacCarthy

(10) Patent No.: US 6,439,957 B1
(45) Date of Patent: Aug. 27, 2002

(54) ELECTRONIC TOY KITCHEN AND A METHOD OF USING THE SAME

(75) Inventor: Joseph M. MacCarthy, Buffalo, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/501,368

(22) Filed: Feb. 11, 2000

(51) Int. Cl.[7] ..... A63H 3/52; A63H 33/30

(52) U.S. Cl. ..... 446/479; 446/481; 446/482; 446/147; 434/127; 434/308; 434/428; 463/35

(58) Field of Search ..... 446/479, 480, 446/481, 482, 14, 147; 434/127, 308, 428

(56) References Cited

U.S. PATENT DOCUMENTS

| | | | |
|---|---|---|---|
| 3,120,717 | A | 2/1964 | Glass et al. |
| 3,133,376 | A | 5/1964 | Orenstein |
| 4,214,401 | A | 7/1980 | Teter |
| D261,404 | S | 10/1981 | Appel et al. |
| 4,332,101 | A | 6/1982 | Tomita |
| 4,333,258 | A | 6/1982 | McCaslin |
| 4,383,386 | A | 5/1983 | Giordano et al. |
| 4,467,553 | A | 8/1984 | Kanda |
| 4,515,359 | A | 5/1985 | Mariol |
| 4,764,147 | A | 8/1988 | Baker et al. |
| 4,768,989 | A | 9/1988 | Moomaw |
| 4,781,646 | A | 11/1988 | Dibley |
| 5,217,402 | A | 6/1993 | Gross et al. |
| 5,306,192 | A | 4/1994 | Caveza et al. |
| 5,314,373 | A | 5/1994 | Caveza et al. |
| 5,360,345 | A | 11/1994 | Braunner et al. |
| 5,429,432 | A | 7/1995 | Johnson |
| D366,293 | S | 1/1996 | Yang |
| 5,528,014 | A | 6/1996 | Goldberg et al. |
| 5,706,613 | A | 1/1998 | Drake et al. |
| D396,502 | S | 7/1998 | Blumenthal |
| D401,291 | S | 11/1998 | Blumenthal |
| 5,890,338 | A | 4/1999 | Rodriguez-Ferré |
| 6,010,339 | A | 1/2000 | McDonald |
| 6,048,251 | A | 4/2000 | Klitsner et al. |
| 6,053,795 | A | 4/2000 | Whitney et al. |
| 6,287,560 | B1 | 9/2001 | Fujii |

FOREIGN PATENT DOCUMENTS

| | | |
|---|---|---|
| WO | WO 80/02340 | 10/1980 |

*Primary Examiner*—Derris H. Banks
*Assistant Examiner*—Ali Abdelwahed
(74) *Attorney, Agent, or Firm*—Cooley Godward LLP

(57) ABSTRACT

The toy kitchen of the invention has a variety of play features, including a countertop, a stove top arrangement, a sink, an answering machine and telephone, and a cookbook. The toy kitchen includes a control system that receives and processes inputs from several switches associated with the various play features. The disclosed stove top arrangement includes a pair of simulated burners on which a child may place a utensil. A switch is placed beneath each burner to sense an object that has been placed on a burner. A simulated cookbook is mounted on the countertop. The cookbook includes a page that is pivotally mounted to the cookbook base so that it can be turned by the child user. When the page is turned to either side of the cookbook, it engages a switch on the cookbook base. When an object is placed on one of the burners, the sound output by the control system varies depending on which side of the page engages the switch.

6 Claims, 31 Drawing Sheets

PHONE LOGIC SEQUENCE

BURNER LOGIC SEQUENCE

PHONE PLAY SEQUENCE

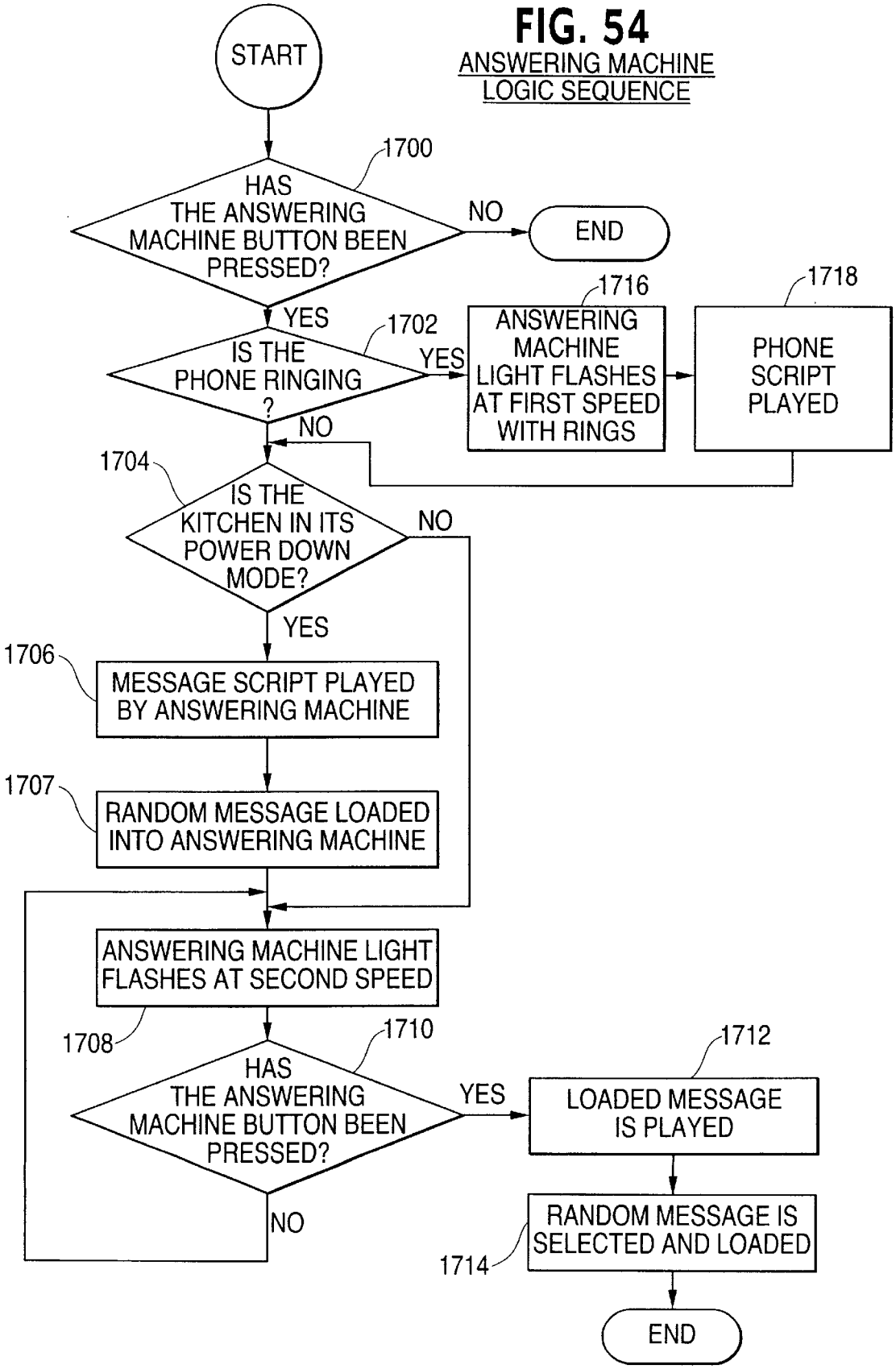
FIG. 54
ANSWERING MACHINE LOGIC SEQUENCE
START
1700
HAS THE ANSWERING MACHINE BUTTON BEEN PRESSED?
NO
END
YES
1702
IS THE PHONE RINGING ?
YES
1716
ANSWERING MACHINE LIGHT FLASHES AT FIRST SPEED WITH RINGS
1718
PHONE SCRIPT PLAYED
NO
1704
IS THE KITCHEN IN ITS POWER DOWN MODE?
NO
YES
1706
MESSAGE SCRIPT PLAYED BY ANSWERING MACHINE
1707
RANDOM MESSAGE LOADED INTO ANSWERING MACHINE
ANSWERING MACHINE LIGHT FLASHES AT SECOND SPEED
1708
1710
HAS THE ANSWERING MACHINE BUTTON BEEN PRESSED?
YES
1712
LOADED MESSAGE IS PLAYED
NO
RANDOM MESSAGE IS SELECTED AND LOADED
1714
END

COOKBOOK LOGIC SEQUENCE

BURNER KNOB LOGIC SEQUENCE

PHONE LOGIC SEQUENCE

FAUCET LOGIC SEQUENCE

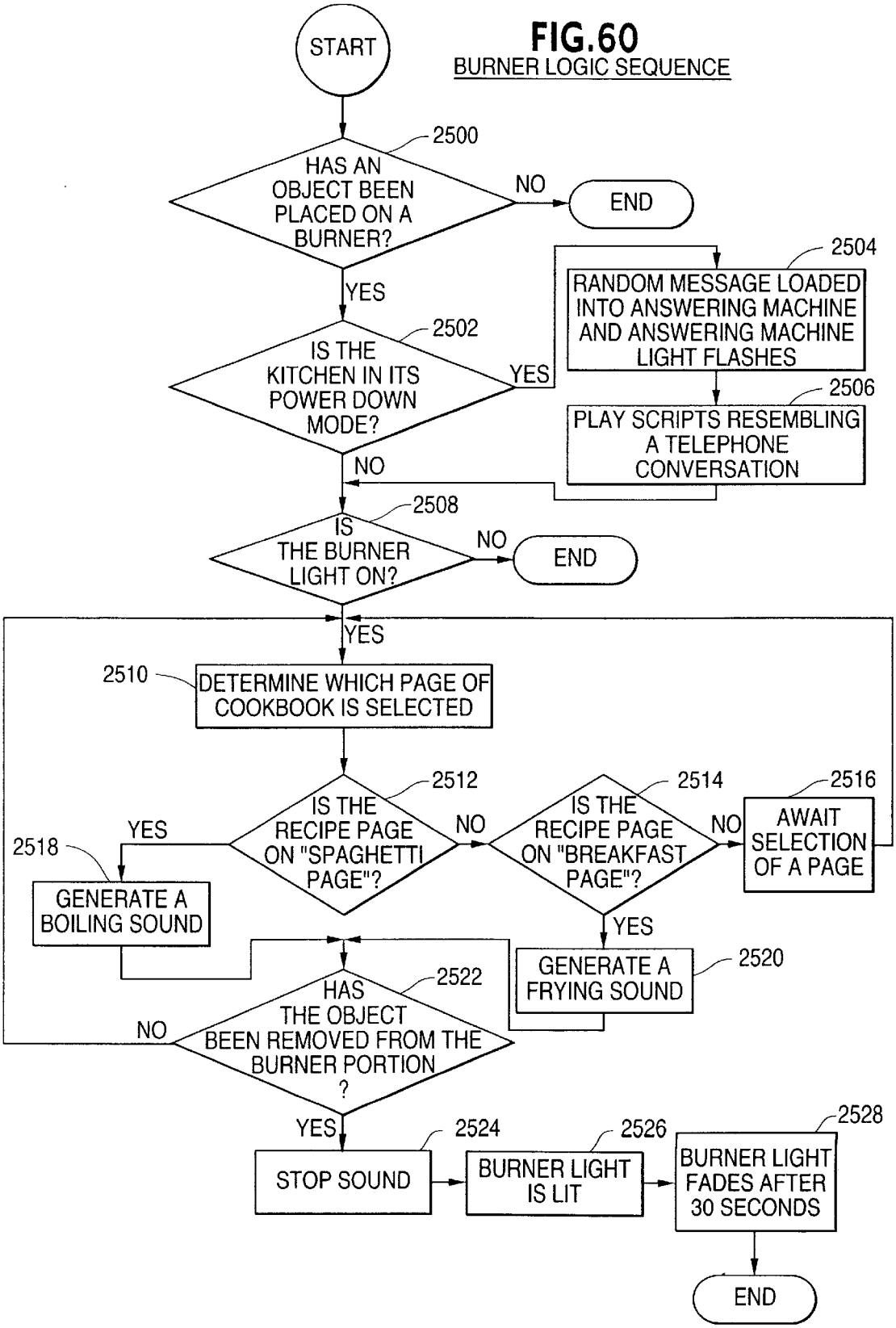
START
FIG.60
BURNER LOGIC SEQUENCE
2500
HAS AN OBJECT BEEN PLACED ON A BURNER?
NO
END
YES
2502
IS THE KITCHEN IN ITS POWER DOWN MODE?
YES
2504
RANDOM MESSAGE LOADED INTO ANSWERING MACHINE AND ANSWERING MACHINE LIGHT FLASHES
2506
PLAY SCRIPTS RESEMBLING A TELEPHONE CONVERSATION
NO
2508
IS THE BURNER LIGHT ON?
NO
END
YES
2510
DETERMINE WHICH PAGE OF COOKBOOK IS SELECTED
2512
IS THE RECIPE PAGE ON "SPAGHETTI PAGE"?
YES
2518
GENERATE A BOILING SOUND
NO
2514
IS THE RECIPE PAGE ON "BREAKFAST PAGE"?
NO
2516
AWAIT SELECTION OF A PAGE
YES
2520
GENERATE A FRYING SOUND
2522
HAS THE OBJECT BEEN REMOVED FROM THE BURNER PORTION ?
NO
YES
2524
STOP SOUND
2526
BURNER LIGHT IS LIT
2528
BURNER LIGHT FADES AFTER 30 SECONDS
END

TELEPHONE PLAY SEQUENCE

ANSWERING MACHINE LOGIC SEQUENCE

ELECTRONIC TOY KITCHEN AND A METHOD OF USING THE SAME

TECHNICAL FIELD AND INDUSTRIAL APPLICABILITY OF THE INVENTION

This invention relates generally to a toy kitchen for children, and in particular, to an electronic toy kitchen that produces various sensory outputs in response to inputs from a child. The invention is particularly useful in teaching children about the function and operation of a kitchen.

BACKGROUND OF THE INVENTION

A popular category of children's toys is generally referred to as "kitchen toys." Kitchen toys entertain children by simulating the activities of their parents in the kitchen. Many kitchen toys include a variety of common kitchen appliances to create a realistic feel to the toy. A variety of conventional kitchen toys are known in the art. The disclosed kitchen toy provides enhanced play value for children by providing more interactive and realistic play patterns.

SUMMARY OF THE INVENTION

The toy kitchen of the invention has a variety of play features, including a countertop, a stove top arrangement, a sink, an answering machine and telephone, and a cookbook. The toy kitchen includes a control system that receives and processes inputs from several switches associated with the various play features. The control system includes a logic program that determines which input has been received and generates an appropriate sensory output in response to the particular input.

The disclosed stove top arrangement includes a pair of simulated burners on which a child may place a utensil. A switch is placed beneath each burner to sense an object that has been placed on a burner.

The disclosed sink includes a rotatably mounted faucet handle. When the handle is turned, it engages a switch that provides an input to the control system that in turn generates an audible output simulating the sound of running water.

A simulated cookbook is mounted on the countertop. The cookbook includes a page that is pivotally mounted to the cookbook base so that it can be turned by the child user. When the page is turned to either side of the cookbook, it engages a switch on the cookbook base. When an object is placed on one of the burners, the sound output by the control system varies depending on which side of the page engages the switch.

The answering machine and telephone are mounted to the frame of the kitchen toy above the countertop. The answering machine includes a lamp that flashes to indicate that a message is waiting to be heard. A phone button or an answering machine button may be pressed to signal the control system to play the message. Several conversational phrases are stored in memory in the control system.

BRIEF DESCRIPTION OF THE DRAWINGS

FIG. 54 is a flowchart of the answering machine logic sequence of an alternate embodiment in accordance with the principles of the invention.

FIG. 60 is a flowchart of the burner logic sequence of a preferred embodiment in accordance with the principles of the invention.

DETAILED DESCRIPTION AND PREFERRED EMBODIMENTS OF THE INVENTION

Figure 1:
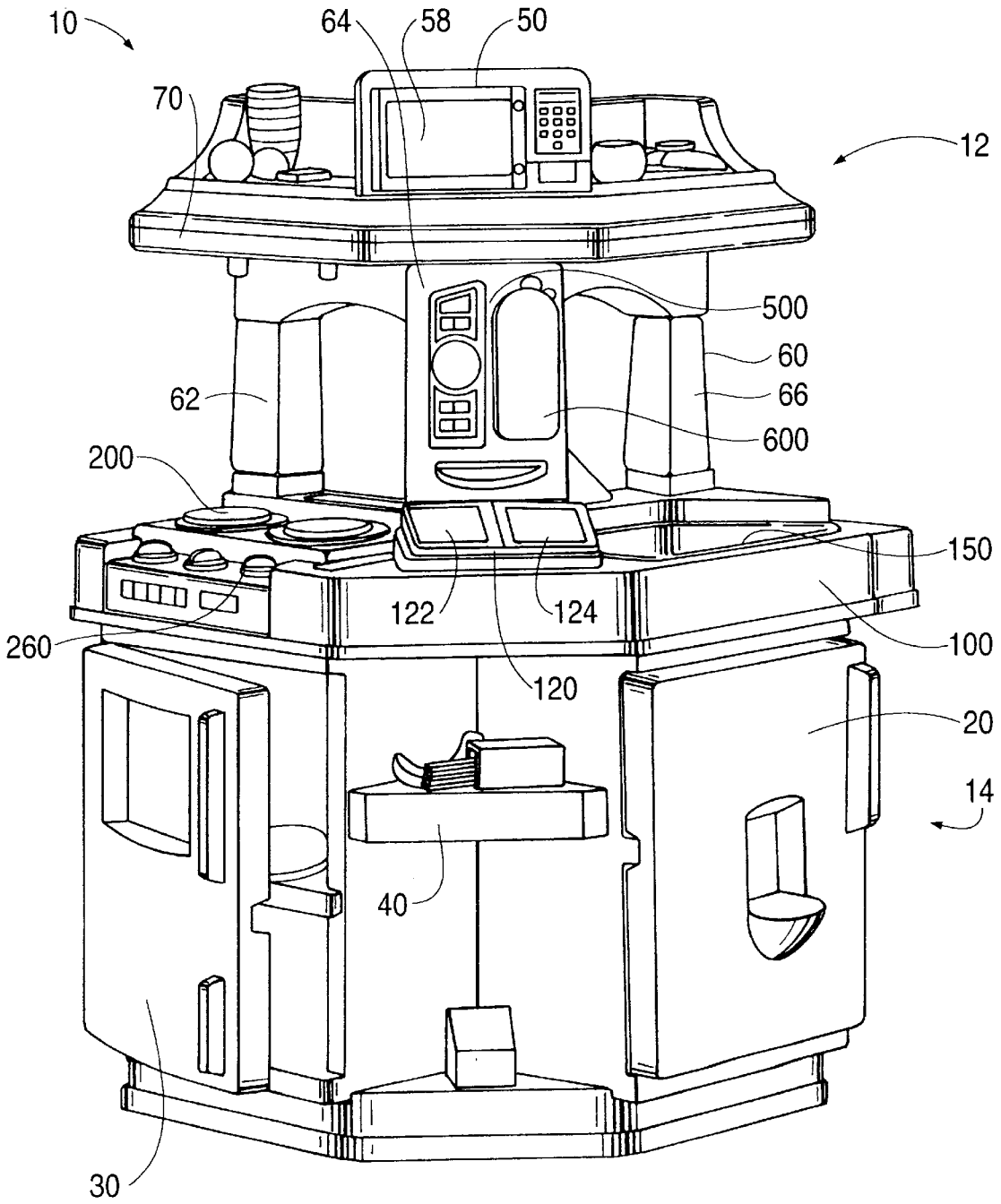
FIG. 1 is a schematic view of a kitchen embodying the principles of the invention.
Figure 62:
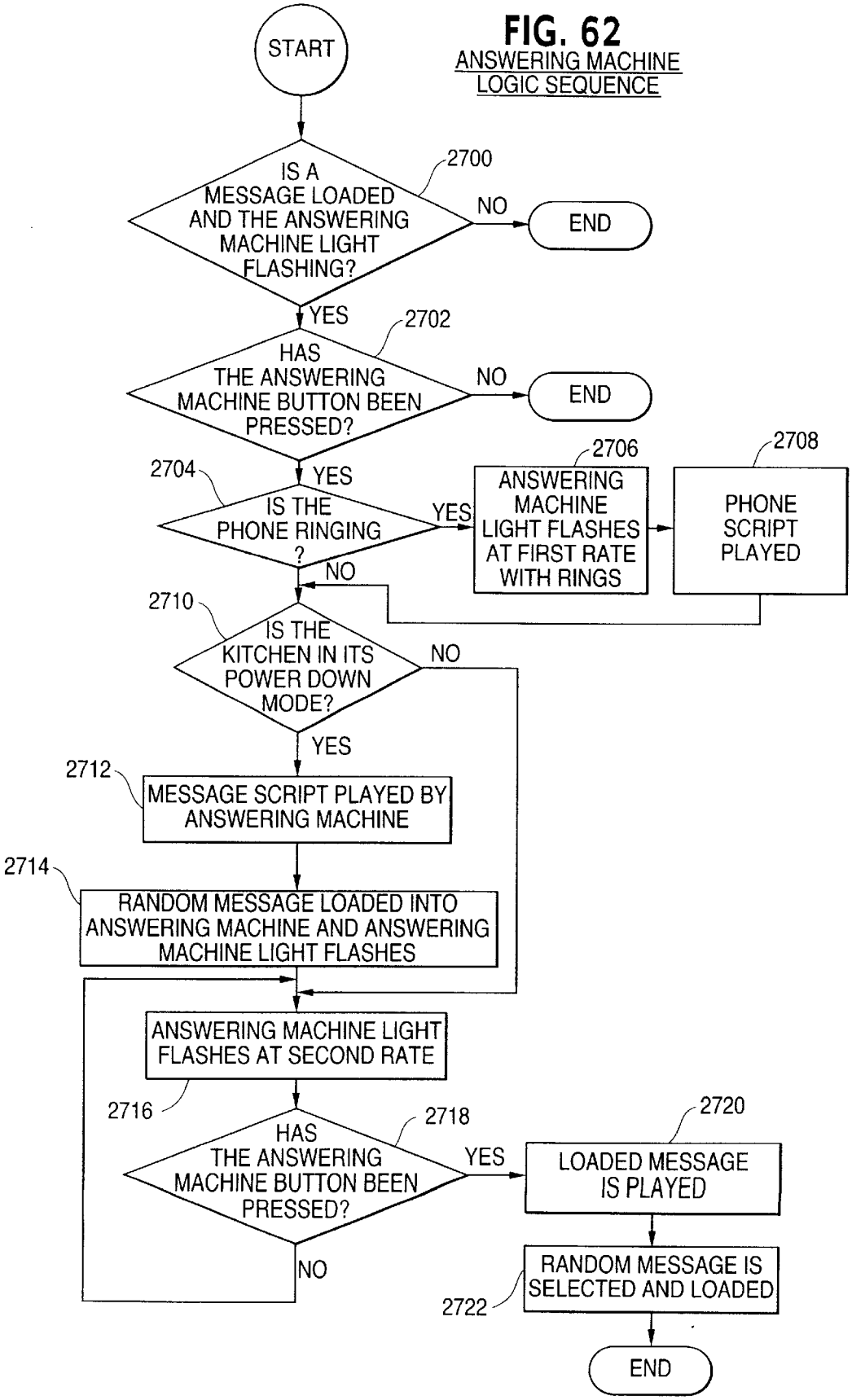
FIG. 62 is a flowchart of the answering machine logic sequence of a preferred embodiment in accordance with the principles of the invention.

Reference will now be made in detail to the presently preferred embodiment of the invention, examples of which are illustrated in the accompanying drawings. As depicted in FIGS. 1 through 62, the preferred embodiment of the toy kitchen of the present invention is a stand-alone kitchen set 10 with an upper portion 12 and a lower portion 14. The kitchen 10 includes a main control unit that is internal to the kitchen. The main control unit receives and processes inputs from a variety of sensors or switches and generates sensory outputs that entertain the child playing with the kitchen 10.

As shown in FIG. 1, the lower portion 14 includes a countertop 100 that is positioned at an appropriate location for children to use.

The lower portion 14 includes several typical kitchen appliances, such as a refrigerator 20 and an oven 30, and a shelf 40 for storing simulated food containers. The upper portion 16 includes a shelf 70 that is supported by a frame 60 that includes legs 62, 64, and 66. The legs 62, 64, 66 are coupled to the shelf 70 by a snap connection. The shelf 70 includes an upper surface on which a toy microwave 50 rests. Microwave 50 includes a door 58-which creates a realistic appearance to the appliance.

Countertop 100 is detachably coupled to the lower portion 14, preferably by a snap connection. Each of the legs 62, 64, 66 of the frame 60 are also connected to the countertop 100 by snap fit connections.

The countertop 100 includes a simulated stove range with a burner arrangement 200, a sink 150, and a cookbook 120. A child may place a utensil on the burner arrangement 200 to achieve particular sensory outputs as discussed in detail below. The cookbook 120 includes a base 126 with two surfaces 122, 124 which have identifying indicia on them, such as a character or a graphical representation of a particular type of food.

The kitchen 10 includes a toy answering machine 500 that is mounted on leg 64 as shown in FIG. 1. The answering machine 500 includes a cradle into which a toy telephone 600 may be placed as shown. The toy telephone is a wireless telephone telephone. The answering machine 500 and telephone 600 generate sensory outputs to entertain the user of the kitchen as discussed in greater detail below.

This embodiment of the kitchen 10 will be discussed in detail and the operation of the kitchen and its control unit will be subsequently discussed.

An implementation of a countertop embodying the principles of the invention is shown in FIGS. 2–5. The countertop 100 includes sides 102, 104, 106, 108, and angled sides 110, 112 defining the lateral perimeter of the countertop 100.

Figure 2:
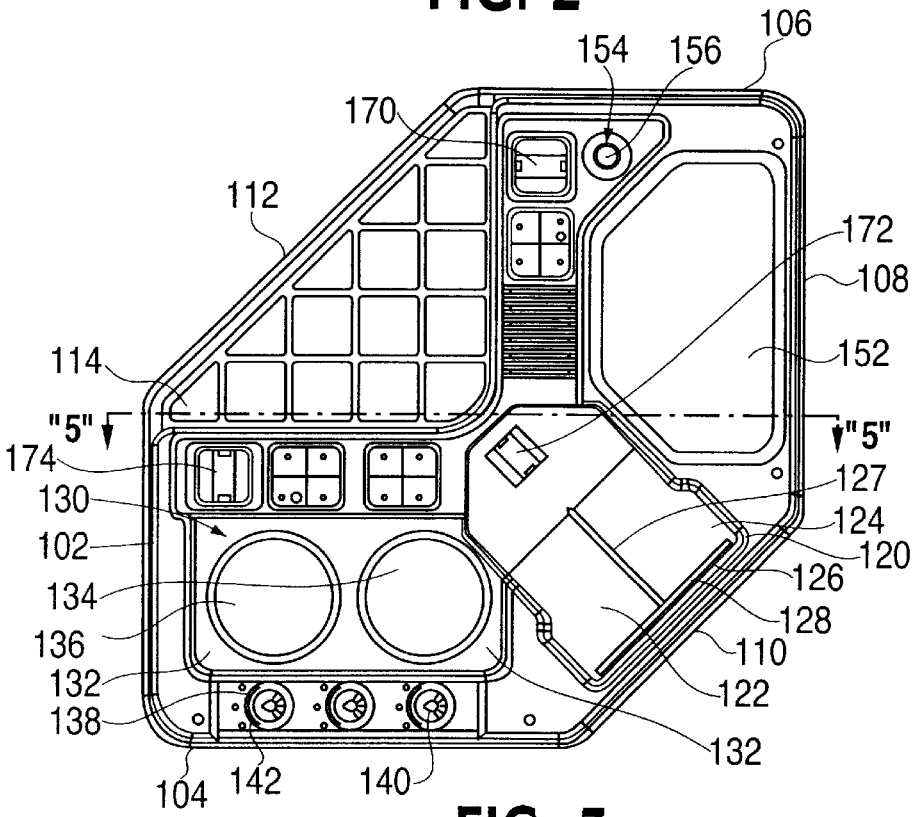
FIGS. 2 and 3 are top and bottom views of the countertop of the kitchen of FIG. 1.

The countertop 100 includes a top surface 114 on which children place utensils and toy food as shown in FIG. 2. The top surface 114 includes mounting apertures 170, 172, 174 into which the bottom portions of the legs 62, 64, 66 are inserted. The sides of the countertop 100 include a ridge 116 along their bottom surface that enables the countertop 100 to be snap fit to the lower portion of the kitchen 10.

Figure 3:
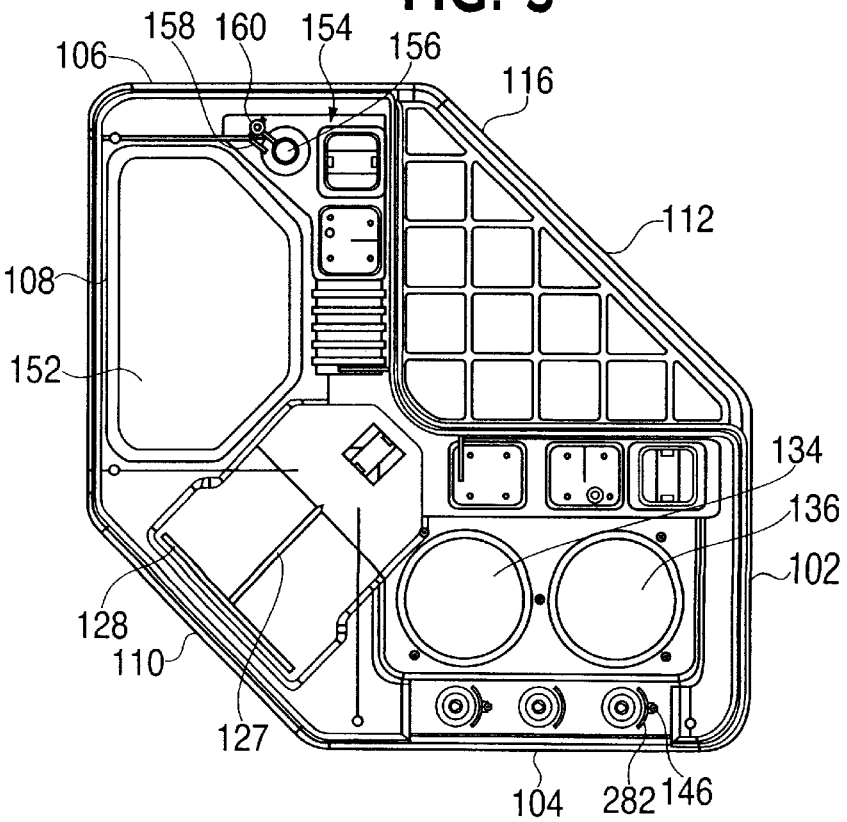
Figure 5:
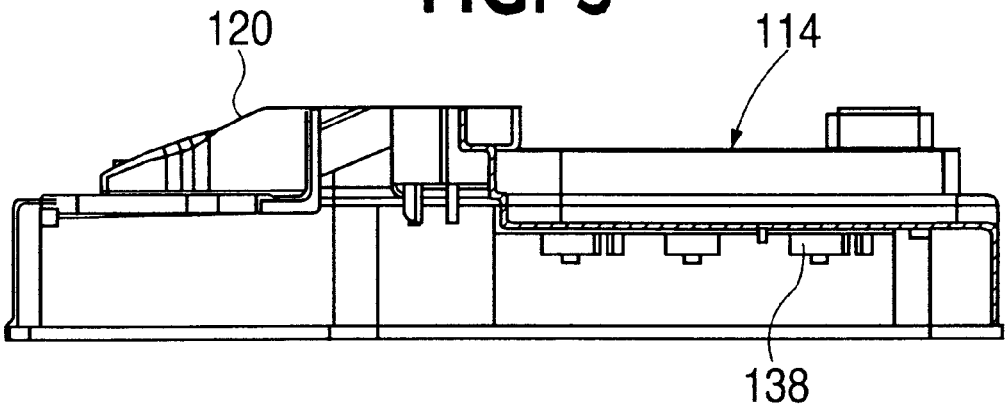
FIG. 5 is a cross-sectional view of the countertop taken along the lines "5"— "5" in FIG. 2.
Figure 6:
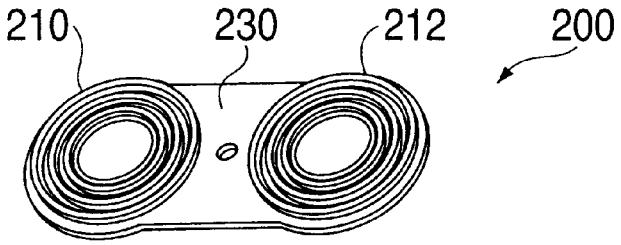
FIG. 6 is a perspective view of the burner arrangement of the kitchen of FIG. 1.

The cooking range 130 includes a plate 132 with burner apertures 134, 136. A panel of dial connections 138 is located at the side of the cooking range 130. Each dial connection 138 includes a center hole 140 and an arcuate aperture 142. The dial connections 138 are shown in FIG. 5. Referring to FIG. 3, a switch 282 is mounted to a switch mount 146. As a burner dial is turned, contact is made with the switch 282 and an input signal is delivered to the main control unit.

The countertop 100 includes a sink aperture 152 into which a sink 150 is mounted. Adjacent to the sink aperture 152 is a handle mount 154 for mounting a faucet handle. Referring to FIG. 3, a switch 158 is mounted to a switch mount 160. As the faucet handle is turned, contact is made with the switch 158 and an input signal is delivered to the main control unit.

Figure 4:
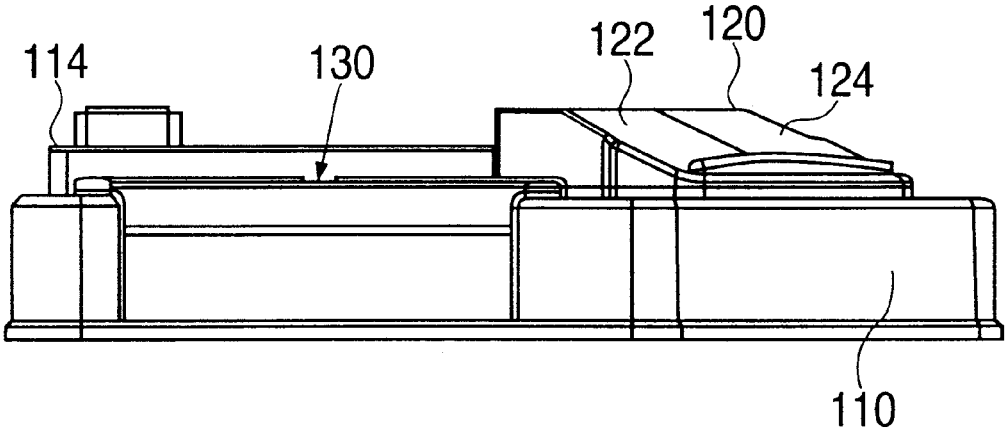
FIG. 4 is a side view of the countertop of FIG. 2.

A simulated cookbook 120 is formed in countertop 100, and includes a base 126 and surfaces 122, 124 as shown in FIGS. 2 and 4. The upper surface of the base 126 is mounted at an angle with respect to the top surface 114 of the countertop 100 as shown in FIG. 4. The cookbook 120 includes a groove 127 and a switch aperture 128. Contact switches are mounted in the switch aperture 128 and are engaged by the cookbook page, as discussed below.

An implementation of a burner arrangement embodying the principles of the invention is shown in FIGS. 6–10B. The burner arrangement 200 includes burner portions 210, 212 and a frame 230. The frame 230 includes a mounting hole 232 through which a fastener may be inserted to secure the frame 230 to the countertop 100.

Figure 7:
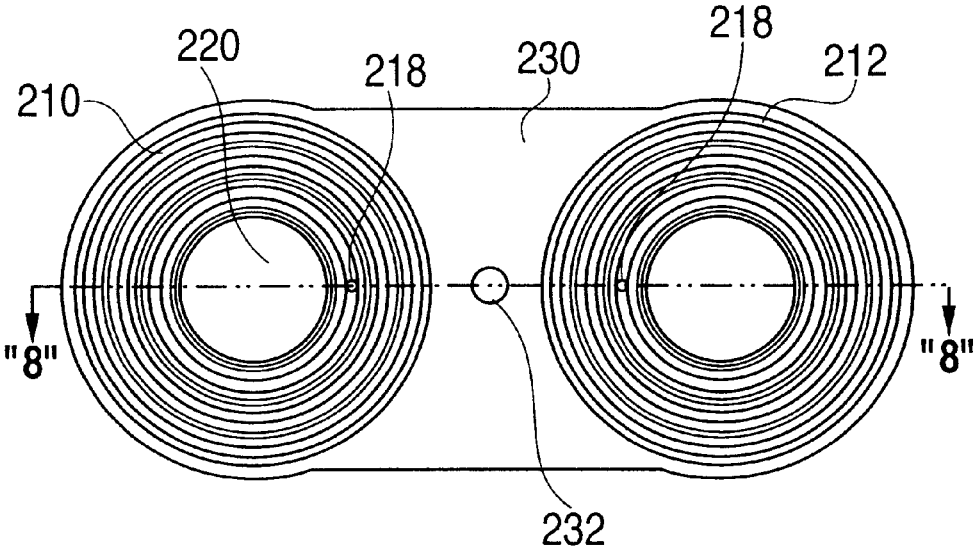
FIG. 7 is a top view of the burner arrangement of FIG. 6.
Figure 8:
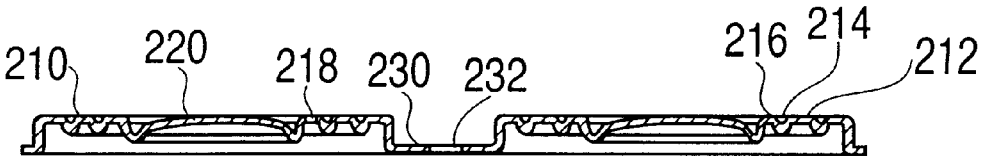
FIG. 8 is a cross-sectional side view of the burner arrangement taken along the lines "8"—"8" in FIG. 7.
Figure 9A:
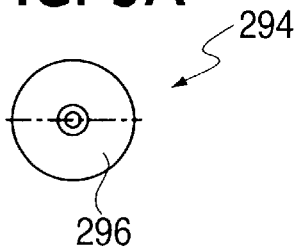
FIGS. 9A and 9B are top and side views of the burner button of the kitchen of FIG. 1.
Figure 9B:
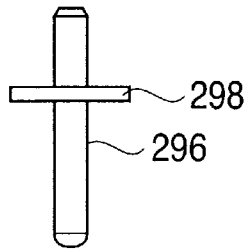
Figure 10A:
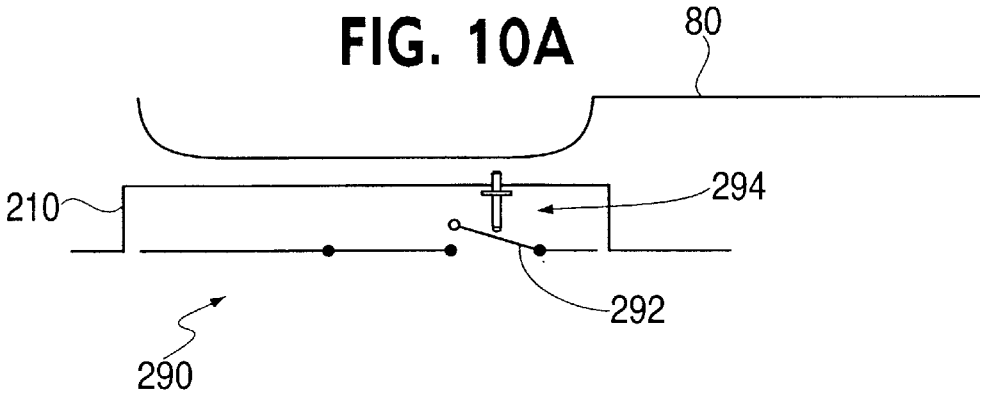
FIGS. 10A and 10B are schematic views showing the operation of the burner top switch in accordance with the principles of the invention.
Figure 10B:
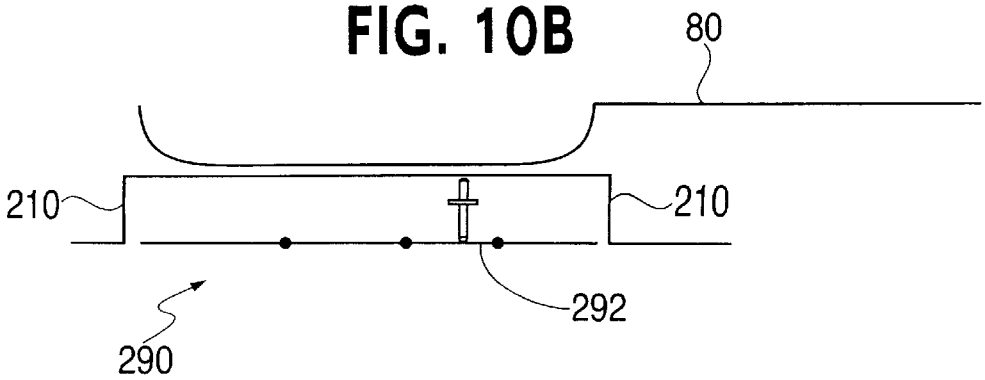

Each burner portion includes a curved portion 220 and a circular pattern of grooves 214 and ridges 216 as shown in FIG. 7. Each burner portion includes a hole 218 through which a burner button 294 is movably positioned as shown in FIGS. 10A and 10B. The burner button 294 includes a shaft 296 and a disc 298 as shown in FIGS. 9A and 9B. Burner button 294 is mounted so that a portion of the shaft 296 extends through hole 218 and above the top surface of each burner portion 210, 212.

A burner switch 290 is mounted beneath each of the burner portions 210, 212. Burner switch is a contact switch with an arm 292 that is engaged by the burner button 294. When a utensil 80 is placed on a burner portion 210, the utensil 80 presses the burner button 294 down to close the burner switch 290. When the burner switch 290 is closed, an input signal is sent to the main control unit 900 and an audio output, such as sounds or speech, is generated. The function of the main control unit 900 and its operation will be discussed in greater detail below.

Figure 11:
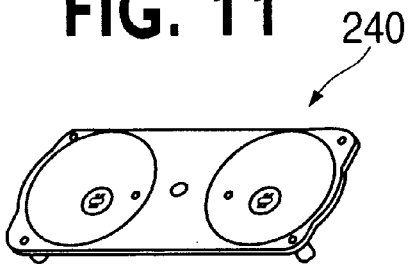
FIG. 11 is a perspective view of the burner support of the kitchen of FIG. 1.
Figure 12:
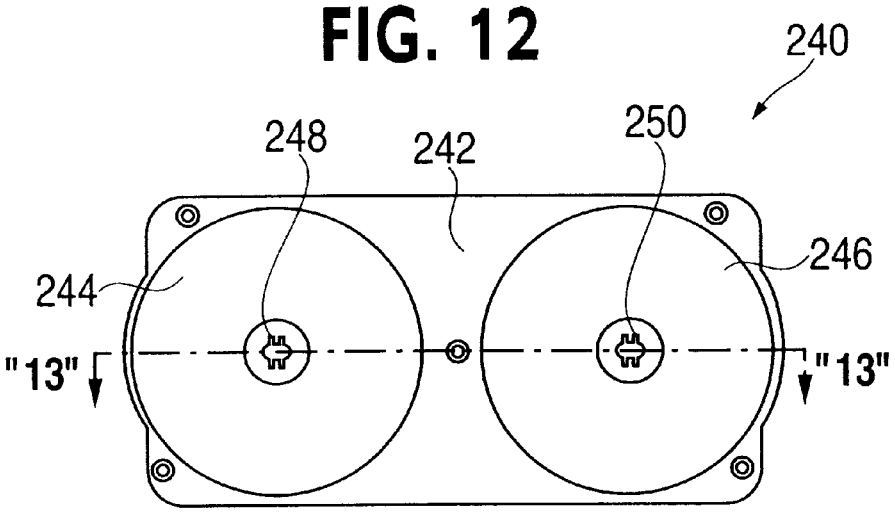
FIG. 12 is a top view of the burner support of FIG. 11.
Figure 13:
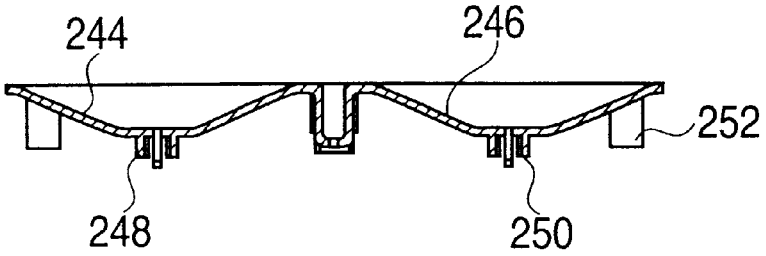
FIG. 13 is a cross-sectional side view of the burner support taken along the lines "13"—"13" in FIG. 12.

An implementation of a burner support embodying the principles of the invention is shown in FIGS. 11–13. The burner support 240 of the kitchen 10 includes a plate 242 with dish portions 244, 246. When the burner support 240 is mounted to the burner arrangement 200, each dish portion 244, 246 is below a burner portion 210, 212.

Dish portions include connections 248, 250 as shown in FIGS. 12, 13. Lamps are mounted into the upper portion of each connection. The lower portion of the connections 248, 250 are electrically connected to the main control unit 900 which operates the lamps. The burner arrangement 200 is made from a transparent plastic material, typically a red color. Accordingly, when a lamp is turned on, the burner portions appear to be on.

The burner support 240 includes mounting posts 252 which facilitate the mounting of the burner support 240 to the countertop 100.

Figure 14A:
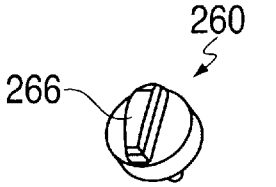
FIGS. 14A and 14B are top and bottom perspective views of the burner knob of the kitchen of FIG. 1.
Figure 14B:
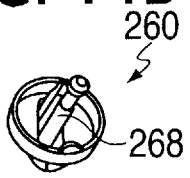

An implementation of a burner dial embodying the principles of the invention is shown in FIGS. 14A–19B. The burner dial or knob 260 also includes a handle portion 266 as shown in FIG. 14A. The knob 260 includes a shaft portion 268 that is inserted into a center hole 140 on the cooking range 130 to mount the knob. The knob 260 includes a ring 262, and upper surface 264 to simulate a knob on a stove.

Figure 15:
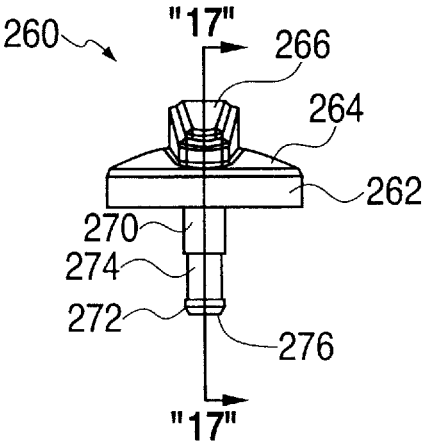
FIGS. 15 and 16 are front and side views of the burner knob of FIG. 14A.
Figure 16:
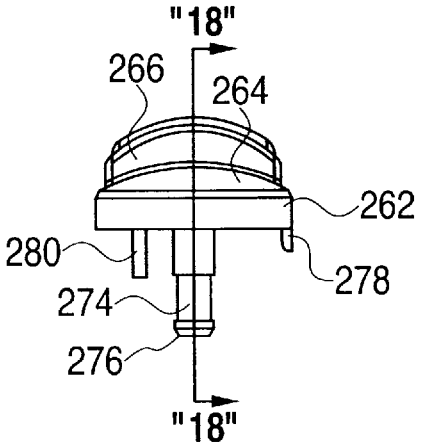
Figure 17:
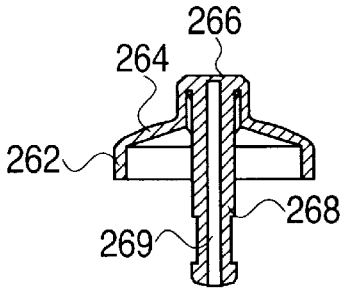
FIG. 17 is a cross-sectional front view of the burner knob taken along the lines "17"—"17" in FIG. 15.

The shaft 268 includes first and second portions 270, 272 and a reduced portion 274 with a smaller diameter along its length as shown in FIG. 15. A tapered end 276 is provided at the end of the shaft 268 to facilitate insertion of the knob 260 into the center hole 140. The knob 260 is rotatably mounted in the center hole 140.

Figure 18:
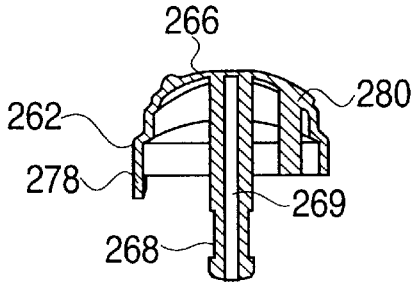
FIG. 18 is a cross-sectional side view of the burner knob taken along the lines "18"—"18" in FIG. 16.
Figure 19A:
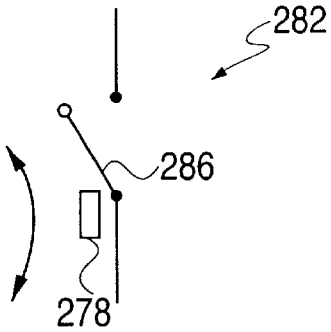
FIGS. 19A and 19B are schematic views showing the operation of the burner knob switch in accordance with the principles of the invention.
Figure 19B:
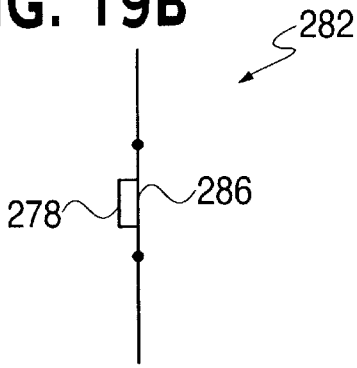
Figure 20:
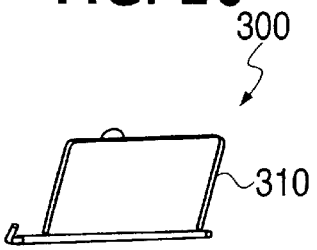
FIG. 20 is a perspective view of the cookbook page of the kitchen of FIG. 1.

The knob 260 includes a tab 278 and an extension 280 that depend from the body of the knob 260 as shown in FIG. 18. The extension 280 engages a clicking mechanism, such as grooves on the countertop, to produce a clicking sound as the knob is turned, as appreciated by the skilled artisan. The tab 278 engages an arm 286 of a switch 282 to close the switch as the knob 260 is turned as shown in FIGS. 19A and 19B. Switch 282 is a contact switch that closes a circuit to generate a signal that is processed by the main control unit 900.

An implementation of a cookbook page embodying the principles of the invention is shown in FIGS. 20–23B. The cookbook page 300 includes a sheet 310 and a spine 320. The page 300 is positioned on the cookbook base 126 so that the spine 320 is rotatably mounted in the groove 127 as shown in FIG. 2.

The sheet 310 has first and second surfaces 312, 314 that have different identifying indicia upon them. The indicia may illustrations of a particular food, such as spaghetti, or a meal, such as breakfast. The sheet 310 includes a handle 316 that a user grasps to turn the page.

Figure 21:
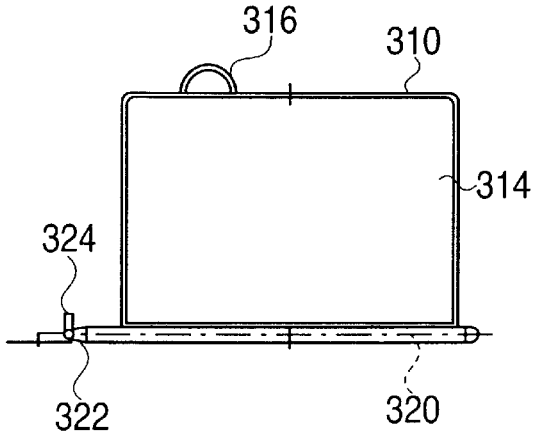
FIGS. 21 and 22 are side and end views of the page of FIG. 20.
Figure 22:
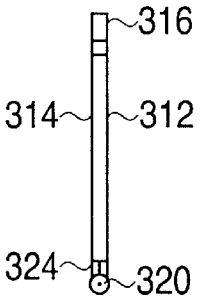
Figure 23A:
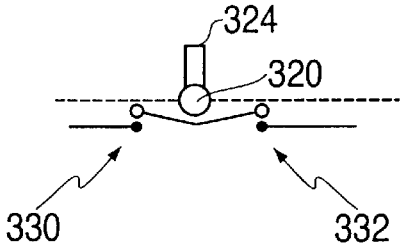
FIGS. 23A and 23B are schematic views showing the operation of the cookbook switch of the kitchen of FIG. 1.
Figure 23B:
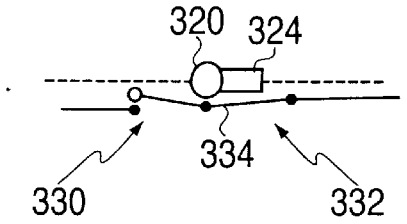
Figure 24A:
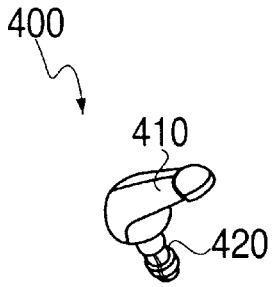
FIGS. 24A and 24B are top and bottom perspective view of the faucet handle of the kitchen of FIG. 1.
Figure 24B:
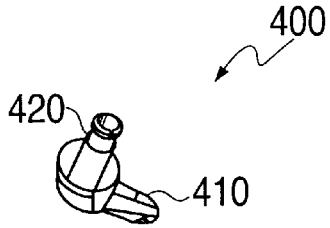
Figure 25:
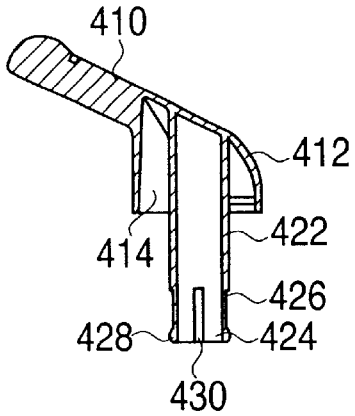
FIG. 25 is a cross-sectional side view of the faucet handle.

The spine 320 includes a tapered portion 322 with an extension 324 as shown in FIG. 21. When the page 300 is turned to one side or the other as shown in FIGS. 23A and 23B, the page 300 pivots about the longitudinal axis of the spine 320. The extension 324 rotates and extends through the switch aperture 128 and engages one of the cookbook switches 330, 332. Cookbook switches 330, 332 are positioned proximate to the switch aperture 128 of the cookbook. The particular switch arm 334, 336 is moved to close the particular switch and send a signal to the main control unit 900.

An implementation of a faucet handle embodying the principles of the invention is shown in FIGS. 24A–27. The faucet handle includes a gripping portion 410 and a mounting portion 420 as shown. The gripping portion 410 includes a wall 412 that defines a cavity 414.

The mounting portion 420 includes a shaft 422 with resilient fingers 424 separated by gaps 430 at its free end. Each finger 424 includes a lip 428 and a recessed portion 426 to mount the handle to the countertop 100. The handle 400 is snap fit to the countertop 100 and may be rotated about the longitudinal axis of the shaft 422.

Figure 26:
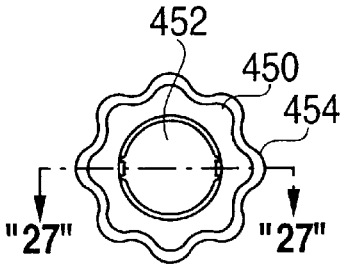
FIG. 26 is a top view of the lock ring of the kitchen of FIG. 1.
Figure 27:
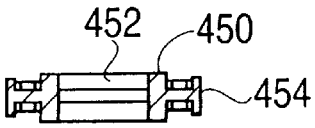
FIG. 27 is a cross-sectional side view of the lock ring taken along the lines "27"—"27" in FIG. 26.
Figure 28:
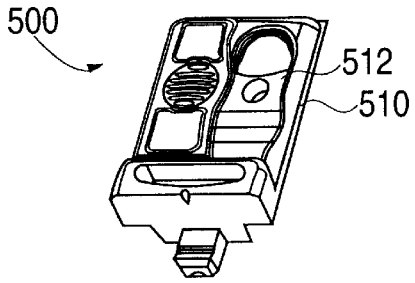
FIG. 28 is a perspective view of the front housing of the answering machine of the kitchen of FIG. 1.
Figure 29:
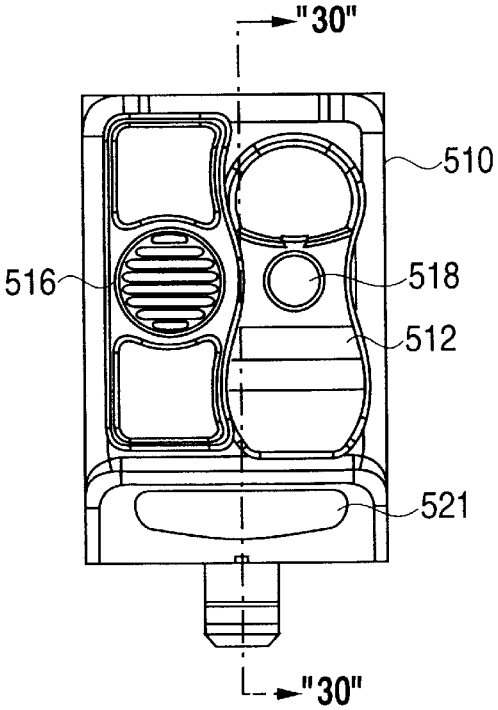
FIG. 29 is a front view of the front housing of FIG. 28.
Figure 30:
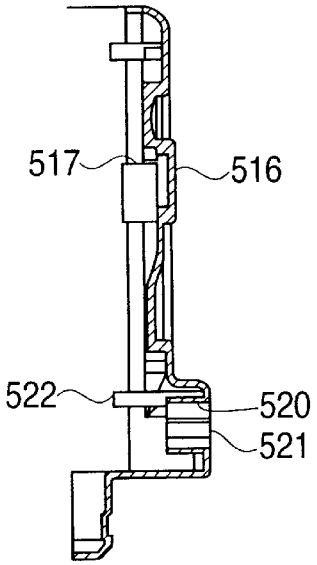
FIG. 30 is a cross-sectional view of the front housing taken along the lines "30"—"30" in FIG. 29.
Figure 31:
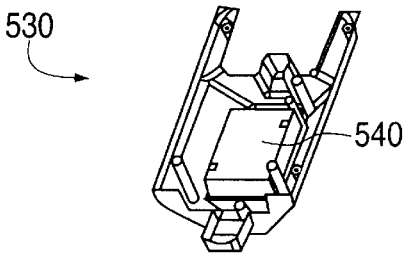
FIGS. 31 and 32 are front and rear perspective views of the rear housing of the answering machine of the kitchen of FIG. 1.
Figure 32:
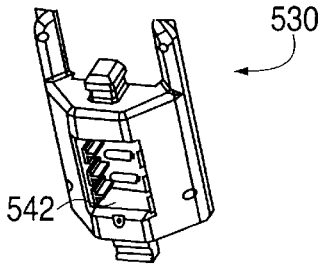

A lock ring 450 is slid onto the shaft 422 of the handle 400. Lock ring 450 includes a central aperture 452 and a perimeter 454 that has a serpentine-like pattern as shown in FIGS. 26 and 27. When the handle 400 is turned, the lock ring 450 turns and its perimeter 454 engages and closes a contact switch 158. When the switch 158 is closed, an input signal is generated and transferred to the main control unit 900. The main control unit 900 generates an audio output in response to the input signal, as discussed in greater detail below.

An implementation of the front and rear housings of a toy answering machine 500 embodying the principles of the invention is shown in FIGS. 28–34. The front housing 510 includes a cradle 512 and a speaker 516. A toy telephone may be positioned in the cradle 512 to simulate the hanging up of the telephone. A speaker 516 is used to play audio outputs that are generated by the main control unit 900. The speaker 516 is a multiple channel speaker that can play multiple audio outputs simultaneously. Preferably, the kitchen 10 can play two different audio outputs through speaker 516 simultaneously.

Figure 33:
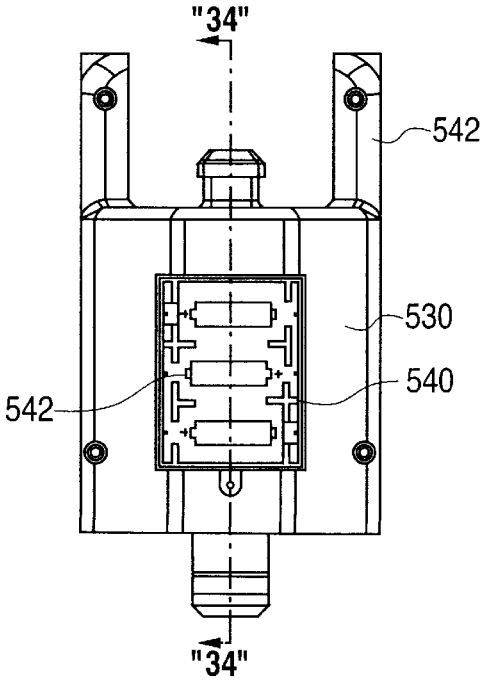
FIG. 33 is a rear view of the rear housing of FIG. 31.
Figure 34:
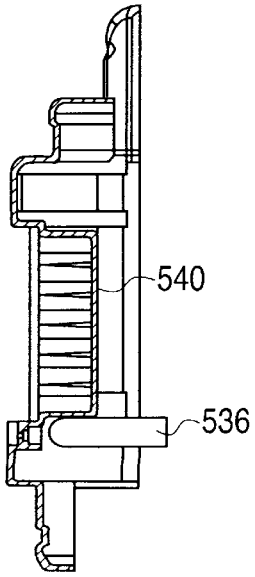
FIG. 34 is a cross-sectional side view of the rear housing taken along the lines of"34"—"34" in FIG. 33.

The front housing 510 includes a tubular member 517 defining an aperture 518 for a phone button 600 and a sleeve member 520 defining an aperture 521 The rear housing 530 includes the power supply for the kitchen 10. The power supply is batteries that are mounted in the battery cavity 542 of the battery compartment 540 as shown in FIGS. 33, 34. The front and rear housings are connected together by fasteners that are inserted through mounting posts 522, 536.

A phone switch 630 is mounted in the answering machine 500 beneath the path of movement of the phone button 700, as will be described later. Also, an answering machine switch 550 is likewise mounted in the answering machine 500 beneath the answering machine button 800. Switches 550, 630 are contact switches.

Figure 35:
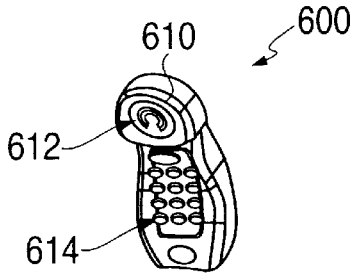
FIGS. 35 and 36 are front perspective views of the rear housing and the front housing of the telephone of the kitchen of FIG. 1.
Figure 36:
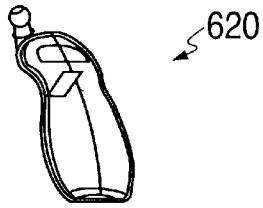
Figure 37:
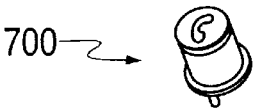
FIGS. 37 and 38 are top and bottom perspective views of the telephone button of the kitchen of FIG. 1.
Figure 38:
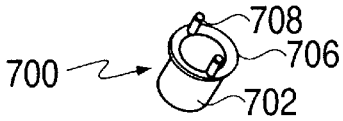
Figure 39:
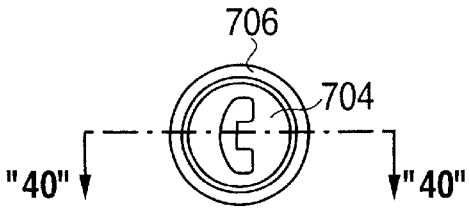
FIG. 39 is a top view of the telephone button of FIG. 37.
Figure 40:
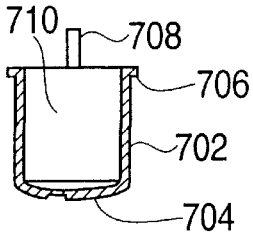
FIG. 40 is a cross-sectional side of the telephone button taken along the lines "40"—"40" in FIG. 39.
Figure 41:
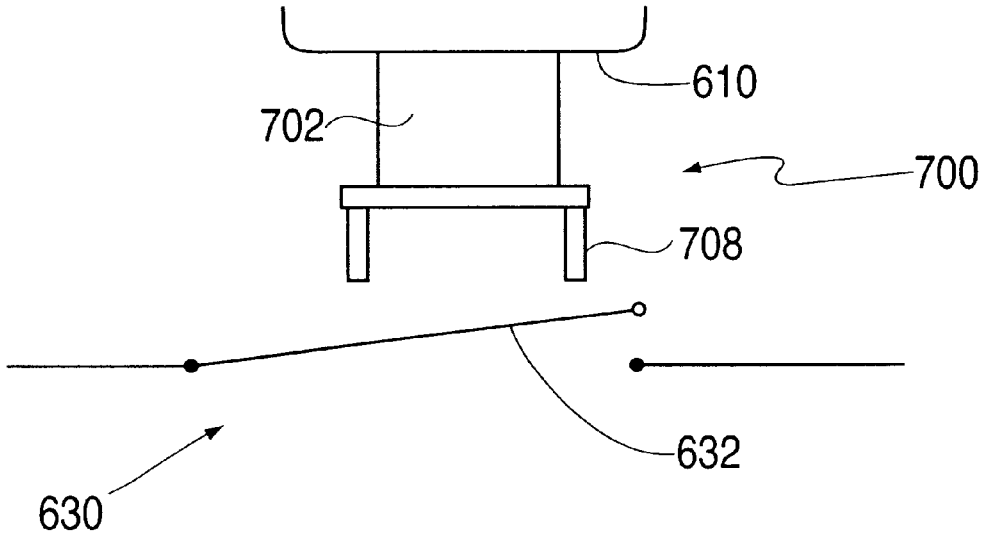
FIGS. 41 and 42 are schematic views showing the operation of the telephone button switch of the kitchen of FIG. 1.

An example of a toy telephone that may be used with the kitchen is shown in FIGS. 35 and 36. The telephone may include separate front and rear housings that are connected together as appreciated by the skilled artisan. The telephone 600 includes a simulated ear portion 612 and dialing portion 614 as shown.

An implementation of a telephone button embodying the principles of the invention is shown in FIGS. 37–42. The telephone button 700 includes a body portion 702 and a rim 706 with extensions 708. The telephone button 700 is mounted in aperture 518 in the answering machine 500. The button 700 may be moved inward and outward relative to the answering machine 500.

When the top surface 704 of the button 700 is pressed, the legs 708 contact an arm 632 of the telephone switch 630 to close the switch. The telephone button 700 closes the telephone switch 630 when a telephone 600 is placed in the cradle 512. The generated input signal informs the main control unit that the telephone is present.

The telephone button 700 may also be used to answer a call if the telephone 600 is not present, similar to the speaker phone function of a real telephone. When the button 700. is pressed and the switch 630 is closed, the main control unit 900 will generate an audio output, such as speech. The audio output is representative of a message that has been left on the answering machine.

An implementation of an answering machine button embodying the principles of the invention is shown in FIGS. 43–46. The structure and operation of the answering machine button is similar to that of the telephone button.

The answering machine button 800 includes a top surface 802, a rim 804, and extensions 806 as shown. The button 800 defines a cavity 808 into which a lamp extends. The button 800 is made from a transparent or semi-transparent material, such as plastic. Accordingly, the user may see light emitting from the lamp when the lamp is operated by the main control unit.

Figure 45:
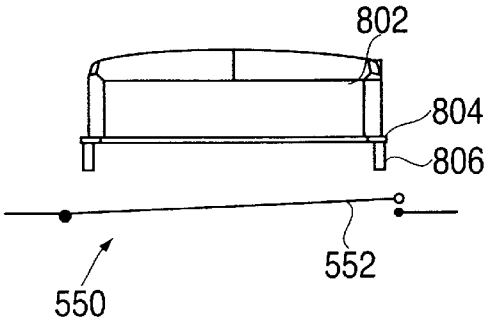
FIGS. 45 and 46 are schematic views showing the operation of the answering button switch of the kitchen of FIG. 1.
Figure 46:
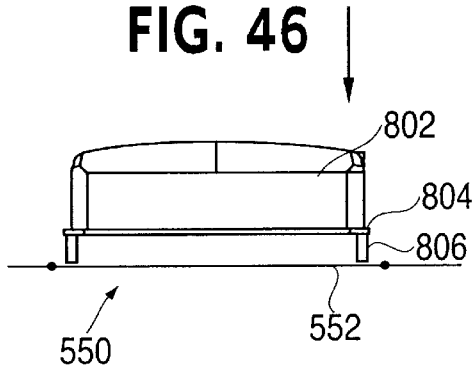

The operation of the answering machine button 800 and the answering machine switch 550 is shown in FIGS. 45 and 46.

Figure 47:
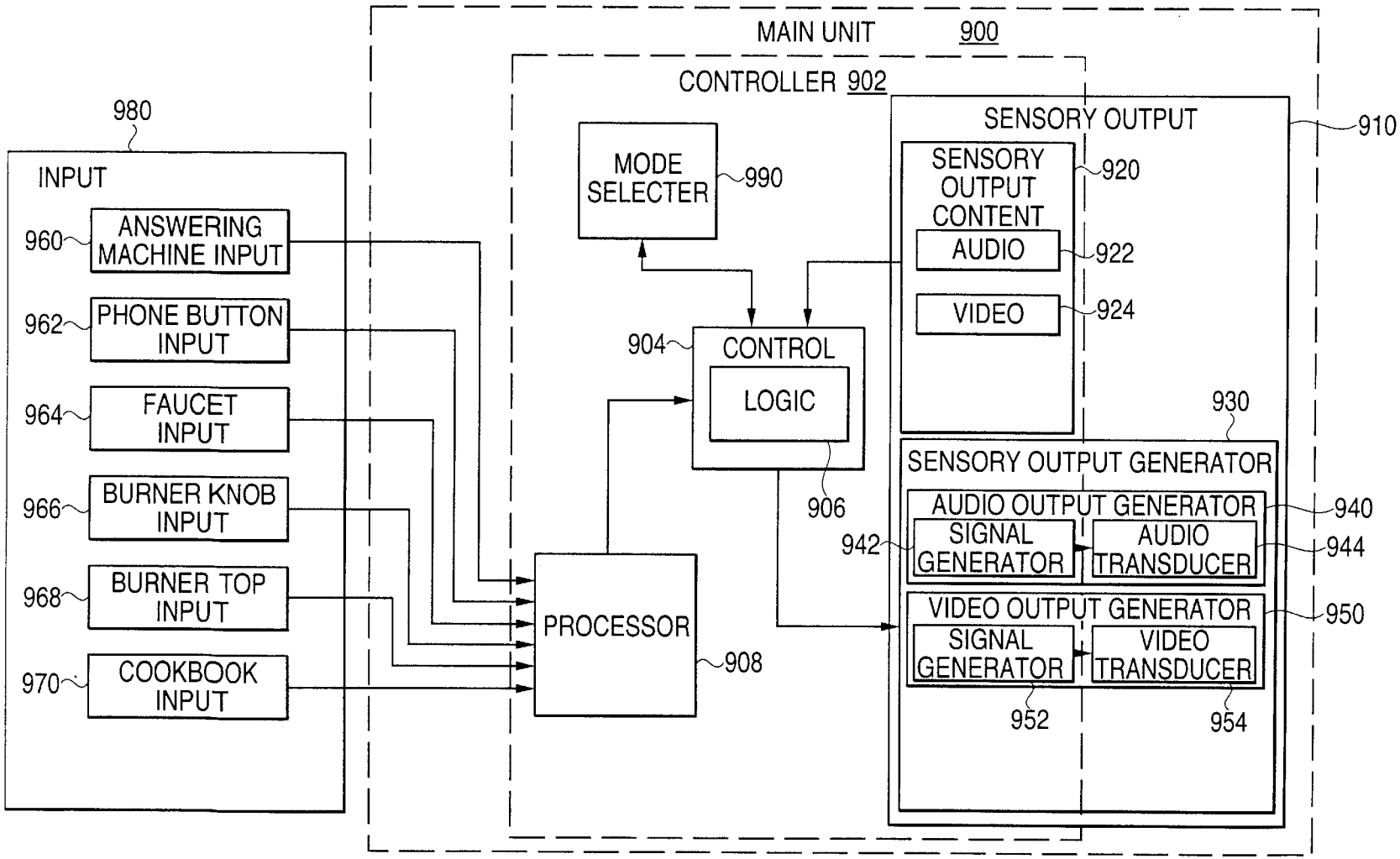
FIG. 47 is a functional schematic block diagram of the control system embodying the principles of the invention.

An implementation of a main controller unit embodying the principles of the invention is shown in FIG. 47.

As shown in the functional block diagram of FIG. 47, the kitchen 10 includes a user input block 980, a control block 902, and a sensory output block 910. In response to a user input received via the input block 980, the control block 902 controls the output of selected sensory output, such as audible output (including sound effects and/or speech), visible output (including light patterns), or tactile output (including vibrations), from the output block 910.

Output block 910 includes sensory output content 920, which includes audio content 922 and video content 924. Audio content 920 can include, for example, in either digital or analog form, speech (recorded or synthesized), or sounds (including recorded natural sounds and electronically synthesized sounds). Video content 924 can include, for example, control signals for activation of lamps or other light-emitting devices.

The output content 920 can be sensibly communicated to a child for hearing or viewing by sensory output generator 930, which can include an audio output generator 940 and a video output generator 950. Audio output generator 940 can include an audio signal generator 942, which converts audio output content 922 into signals suitable for driving an audio transducer 944, such as a speaker, for converting the signals into audible sound waves. Video output generator 950 can include a video signal generator 952, which converts video output content 924 into signals suitable for driving a video transducer 954, such as lights, for converting the signals into visible light waves. The selection of the output content, and the performance attributes of the output generators, should be informed by the goal of generating sensory output that is appealing to the children playing with the kitchen.

Control block 904 controls sensory output block 910, selecting the output content to be output and activating the output generator 930 to operate on the selected output content. The operation of control block 904 can be governed by control logic 906, which can be, for example, computer software code. Control logic 906 can select content to be output repetitively or non-repetitively, randomly or in fixed sequences, and/or for short or long durations. The video and audio output can be coordinated to enhance the pleasing effect.

The controller 902 includes a mode selector 990 that selects between a shut down mode and an operating mode for the kitchen. Controller 902 includes an internal timer by which it can monitor the time that has elapsed since a command signal was received. If the elapsed time exceeds a predetermined amount of time, the main unit 900 of the kitchen 10 is powered-down to conserve energy. Once powered-down, the main unit 900 will not produce sensory output until another user input is received. The timing mechanism resets itself when the control block 904 receives a user input. If the predetermined amount of time has passed without an input, the mode selector 990 instructs the control block 904 to power-down the electronics in the kitchen.

The user input block 980 may include several user inputs. In the illustrated embodiment, the user inputs include: an answering machine.input 960, a telephone button input 962, a faucet input 964, a burner knob input 966, a burner top input 968, and a cookbook input 970. Each of these inputs is received from a corresponding switch or sensor when activated by the user (such as when a particular switch is closed). In the illustrated embodiment the switches are contact switches.

When the control block 904 receives an input from the user input block 980 via the processor 908, the control block 904 determines from the mode selector 990 which mode the kitchen is in. The relevance of which mode the kitchen is in will become apparent in the discussion of the logic sequence flowcharts below.

The operation of the kitchen will now be described. As discussed above, the operation of the lamps and the speaker 516, are controlled by controller 902. Controller 902 receives input from the user input block 980 and responds by causing the speakers and/or lights to produce sensory output depending on the mode of the kitchen. If the processor 908 recognizes signals from one of the inputs 960, 962, 964, 966, 968, 970, the controller 902 will cause sensory output to be produced.

Power for the main unit 900 is supplied by main unit power supply, which in the illustrated embodiment consists of batteries (three C-sized cells), which are housed in a battery compartment and accessed via a battery cover.

Cookbook Logic Sequence

Figure 48:
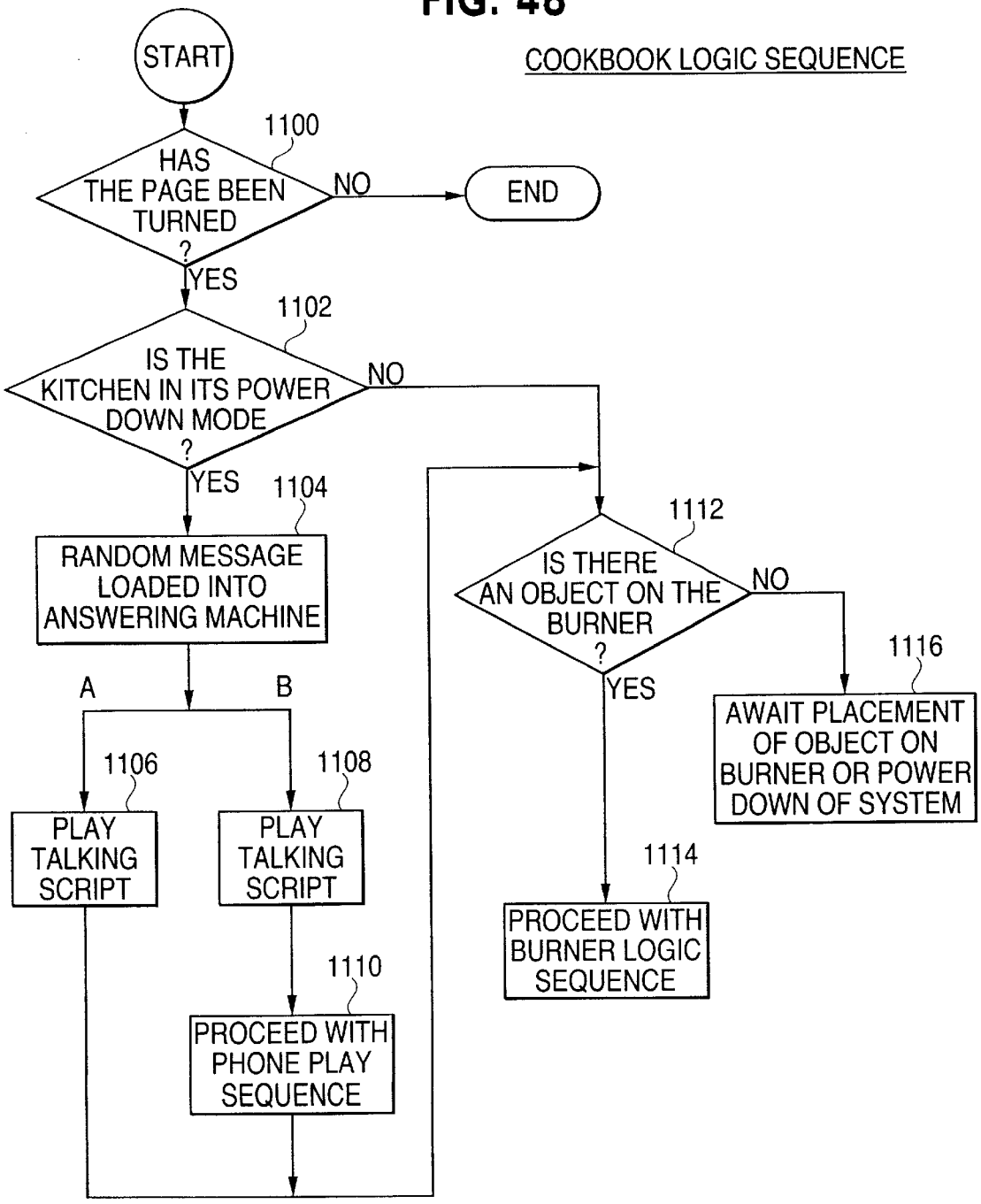
FIG. 48 is a flowchart of the cookbook logic sequence of an alternate embodiment in accordance with the principles of the invention.

Turning to the sequence of operation of the kitchen relative to the cookbook, the cookbook logic sequence is set forth in FIG. 48.

When the page 300 of the cookbook 120 is turned so that one of the extension 324 contacts one of the switches 330, 332, the particular cookbook switch 330, 332 is closed. In step 1100, the control block 904 determines whether the cookbook input 970 received a signal from either switch 330, 332 and forwarded it to the processor 908. If the page was not turned, the system remains in its current state.

After an input has been received from the cookbook input 970, the control block 904 determines which mode the kitchen is in from the mode selector 990 (step 1102). If the kitchen is in the power-down mode, a random message in the audio output content 922 is loaded into memory in the control block 904 (step 1104) and the lamp beneath the answering machine button flashes.

The control block 904 randomly selects between two sequence branches as shown in FIG. 48. In the illustrated embodiment, the "A" branch is selected approximately 80% of the time and the "B" branch is selected approximately 20% of the time. Note that these percentages and the percentages below are only examples and are not limited to the referenced values.

In steps 1106 and 1108, the audio transducer 944 produces an output of speech at a level that is comfortable to the children playing with the kitchen. The particular sensory output that is generated in this embodiment is the talking script of a voice simulating a chef The script contains a few instructions related to cooking (such as "We will need spaghetti, sauce and meatballs." or "Now add the sauce.") and is generated by randomly selecting sentences or phrases from the memory of the audio output content 922.

Figure 53:
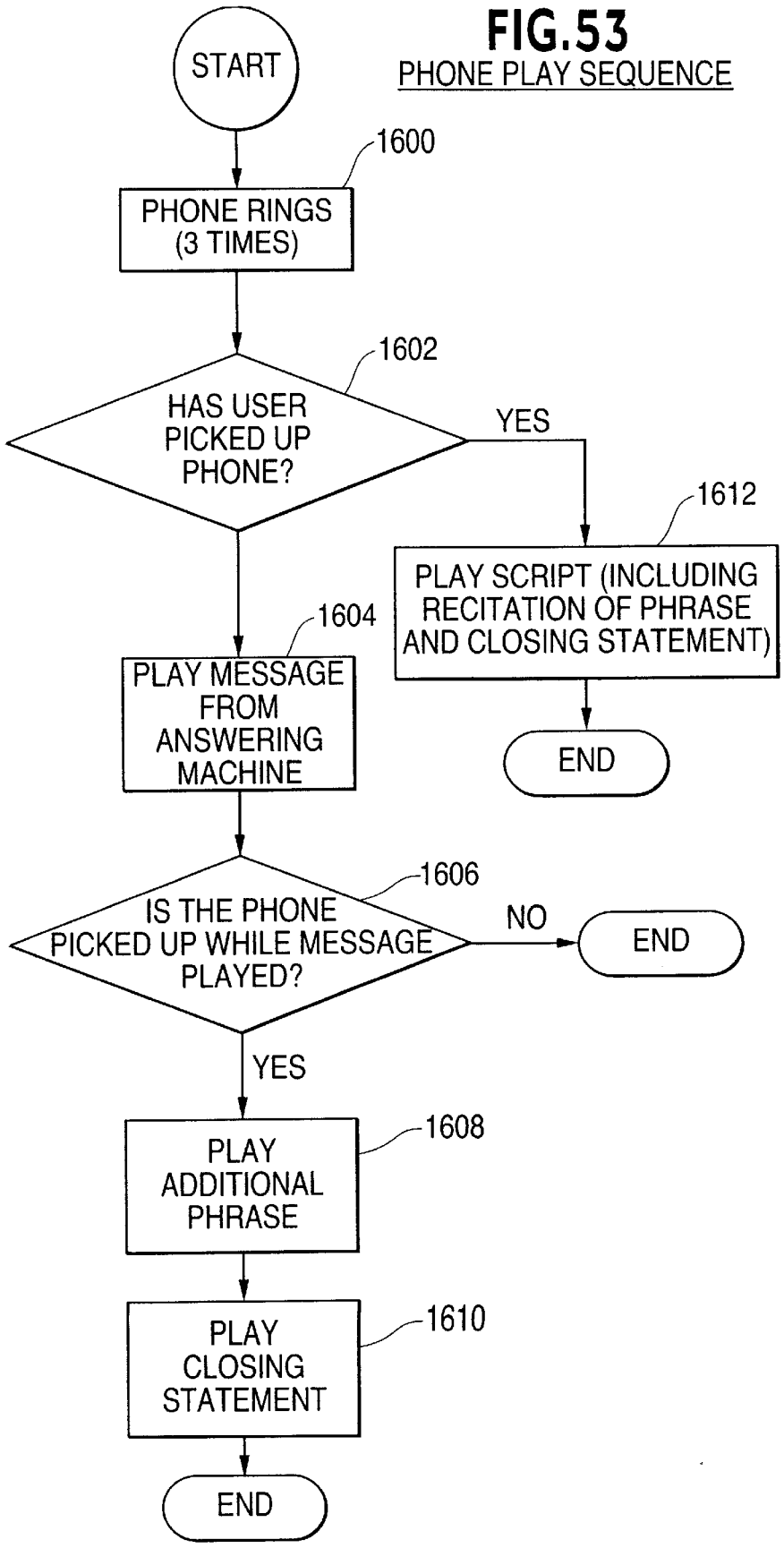
FIG. 53 is a flowchart of the telephone play logic sequence of an alternate embodiment in accordance with the principles of the invention.

After the script is played, the logic sequence of branch "B" proceeds with the Telephone Play Logic Sequence as identified in FIG. 53. Upon completion of the Telephone Play Logic Sequence, the control block 904 continues the logic of the Cookbook Logic Sequence.

At this point, the control block 904 and logic 906 is at step 1112 whether or not the kitchen was in its power-down mode. In step 1112, the control block 904 determines if an object has been placed on one of the burners of the cooking range by whether the processor 908 has received an input from the burner top input 968. If there is no object on a burner, then the controller 902 awaits for the placement of a utensil on the burner and powers-down if no input is received after a predetermined amount of time. If an object is on the burner, the control block 904 proceeds with the Burner Logic Sequence as set forth on FIG. 52.

Burner Knob Logic Sequence

Figure 49:
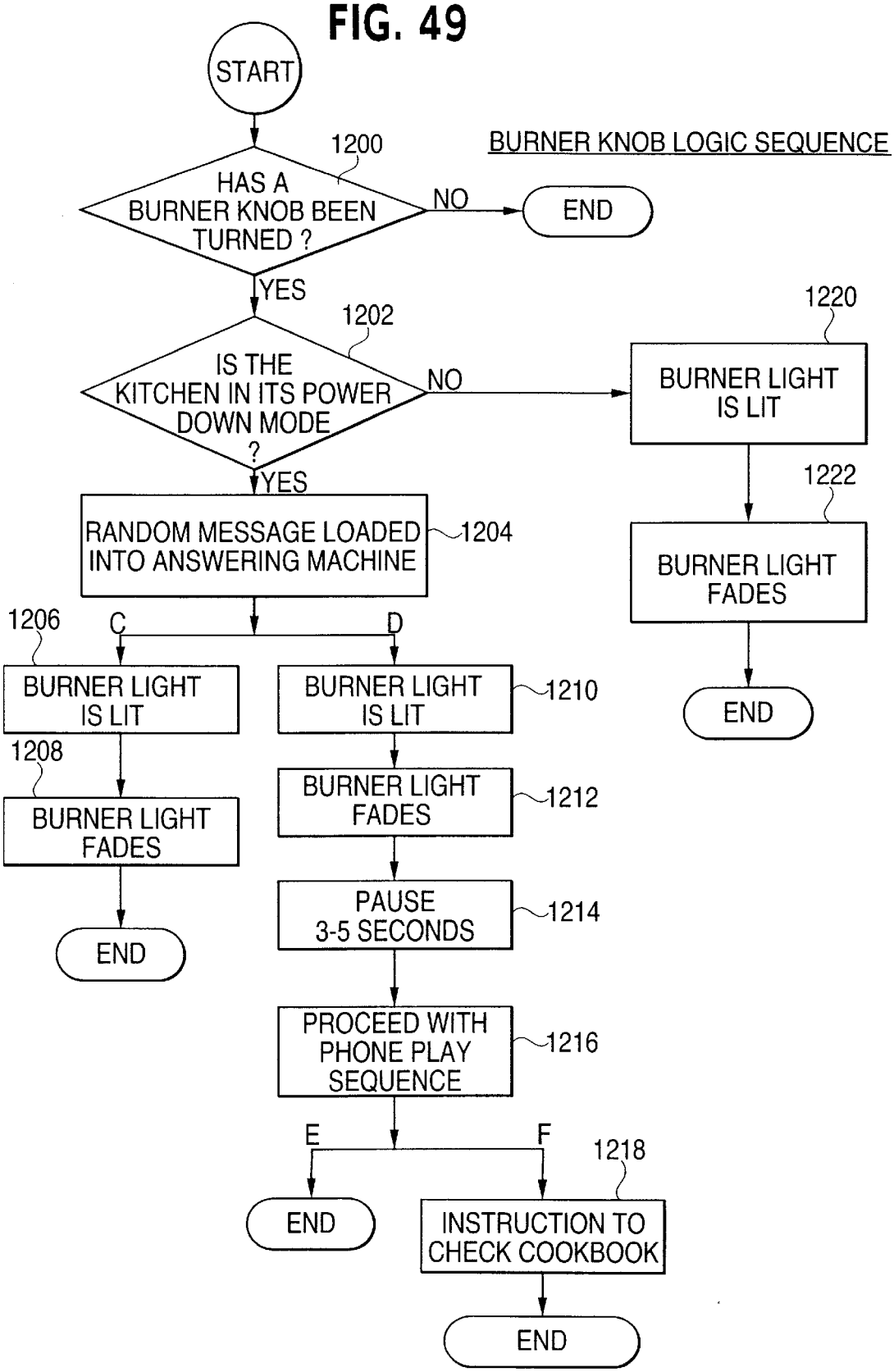
FIG. 49 is a flowchart of the burner knob logic sequence of an alternate embodiment in accordance with the principles of the invention.

Turning to the sequence of operation of the kitchen relative to the burner knobs or dials, the burner knob logic sequence is set forth in FIG. 49.

When a burner knob or dial 260 is turned, the appropriate burner knob switch 282, 284 is closed. In step 1200, the control block 904 determines whether the burner knob input 966 has received a signal from either switch 282 or 284 and forwarded it to the processor 908. If none of the burner knobs was turned, the system remains in its current state.

After an input has been received from the burner knob input 964, the control block 904 determines which mode the kitchen is in from the mode selector 990 (step 1202). If the kitchen is in the power-down mode, a random message in the audio output content 922 is loaded into memory in the control block 904 (step 1204) and the lamp beneath the answering machine button is illuminated.

Figure 52:
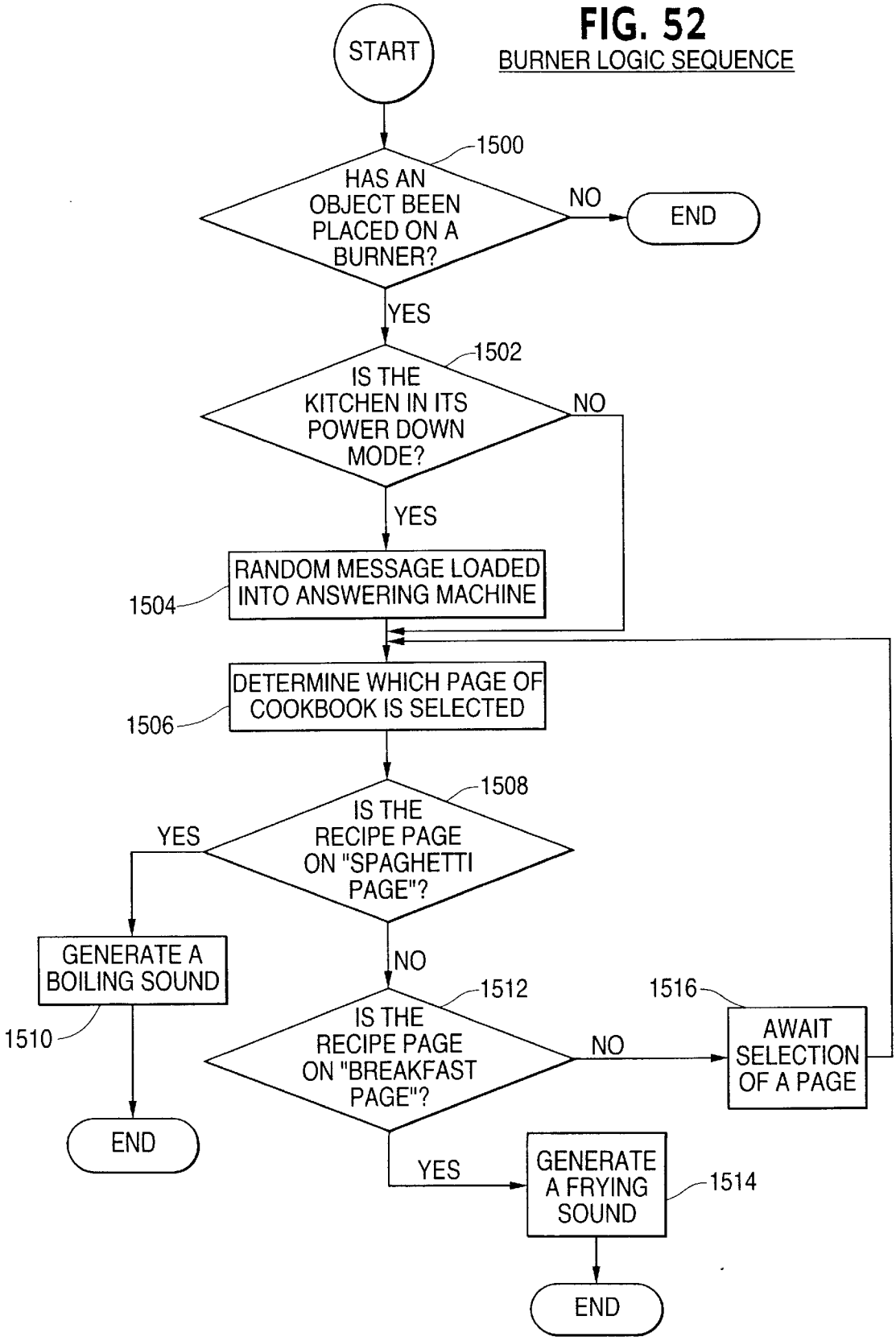
FIG. 52 is a flowchart of the burner logic sequence of an alternate embodiment in accordance with the principles of the invention.

The control block 904 randomly selects between two sequence branches as shown in FIG. 52. In the illustrated embodiment, the "C" branch is selected approximately 40% of the time and the "D" branch is selected approximately 60% of the time.

In steps 1206 and 1210, the video transducer 944 produces a sensory video output from the sensory video output content 924. The particular sensory output that is generated in this embodiment is the illumination of one or both lights under the burner arrangement. When one of the lights is illuminated, the burner appears to be on and ready to cook and the child can pretend to cook food by placing a toy utensil on the burner.

After the burner light is illuminated, the control block 904 includes a timer that indicates when a predetermined amount of time has elapsed, at which point the light begins to fade and eventually shuts off (steps 1208, 1212) unless an object is placed on one of the burner portions.

After the burner light is lit, the logic sequence of branch "D" causes the control block 904 to pause a brief period, such as three to five seconds (step 1214). In step 1216, the control block 904 proceeds with the Telephone Play Logic Sequence as identified in FIG. 53. Upon completion of the Telephone Play Logic Sequence, the control block 904 continues the logic of the Cookbook Logic Sequence. The control block 904 randomly selects between two sequence branches as shown in FIG. 49. In the illustrated embodiment, the "E" branch is selected approximately 20% of the time and the "F" branch is selected approximately 40% of the time.

In the "F" branch, the audio output generator 940 generates a spoken sentence or phrase. (step 1218). In the illustrated embodiment, the spoken phrase is an instruction to the child to check the cookbook.

Returning to the determination of which mode the kitchen is in, in step 1220, the video transducer 944 produces a sensory video output from the sensory video output content 924. The particular sensory output that is generated in this embodiment is the illumination of one or both lights under the burner arrangement. When one of the lights is illuminated, the burner appears to be on and ready to cook and the child can pretend to cook food by placing a toy utensil on the burner.

After the burner light is illuminated, the control block 904 includes a timer that indicates when a predetermined amount of time has elapsed, at which point the light begins to fade and eventually shuts off (step 1222) unless an object is placed on one of the burner portions.

Faucet Logic Sequence

Figure 50:
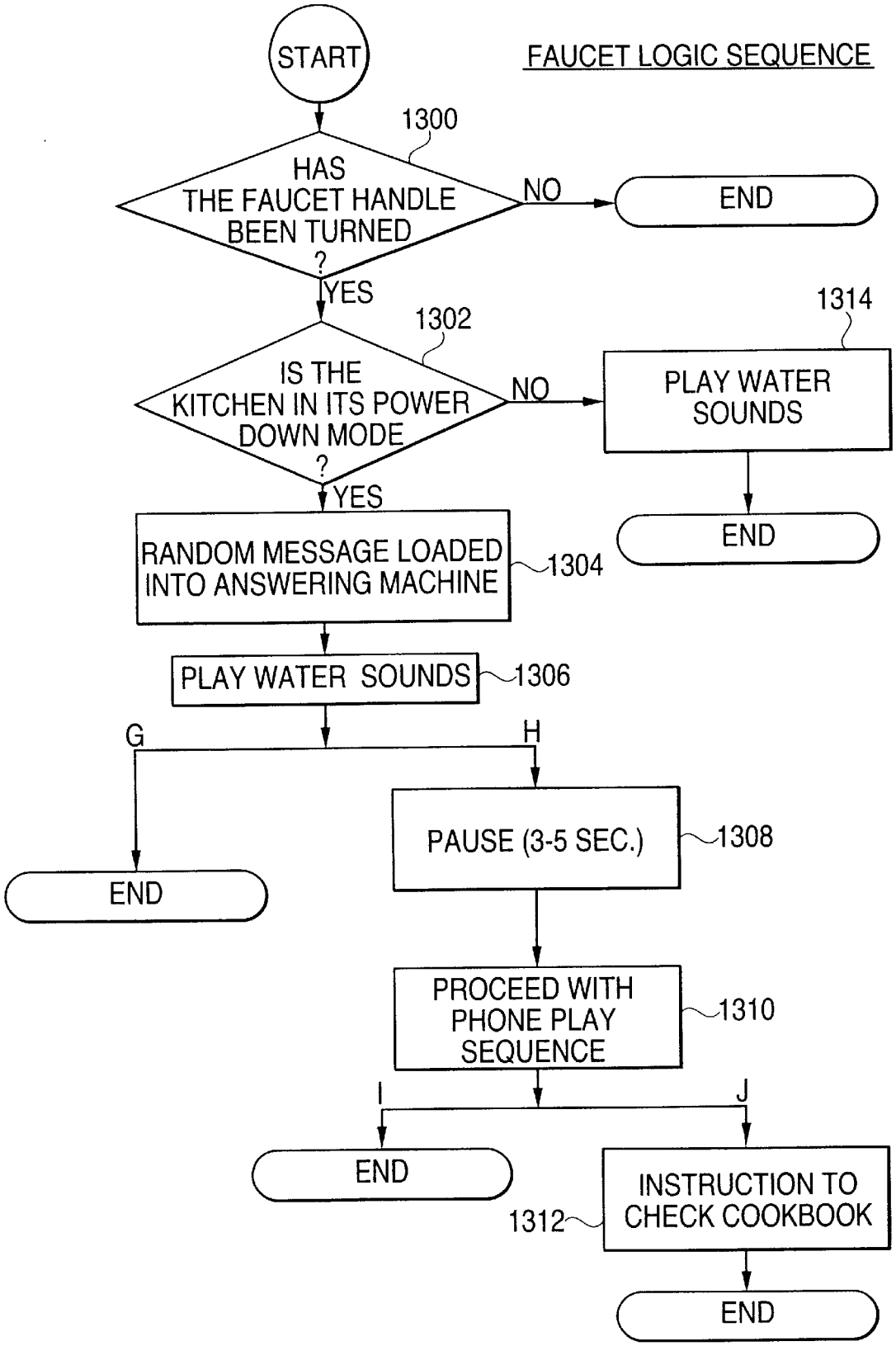
FIG. 50 is a flowchart of the faucet logic sequence of an alternate embodiment in accordance with the principles of the invention.

Turning to the sequence of operation of the kitchen relative to the faucet handle, the faucet logic sequence is set forth in FIG. 50.

When the faucet handle 400 is turned, the appropriate faucet handle switch 440 is closed. In step 1300, the control block 904 determines whether the faucet input 964 has received a signal from switch 440 and forwarded it to the processor 908. If the faucet handle was not turned, the system remains in its current state.

After an input has been received from the faucet input 964, the control block 904 determines which mode the kitchen is in from the mode selector 990 (step 1302). If the kitchen is in the power-down mode, a random message in the audio output content 922 is loaded into memory in the control block 904 (step 1304). The control block 904 randomly selects between two sequence branches as shown in FIG. 50. In the illustrated embodiment, the "G" branch is selected approximately 40% of the time and the "H" branch is selected approximately 60% of the time.

In step 1306, the audio transducer 944 produces an audio sensory output at a level that is comfortable to the children playing with the kitchen. The particular sensory output that is generated in this embodiment is the sound of running water.

After the water sounds are generated, the logic sequence of branch "G" causes the control block 904 to stop. The logic sequence of branch "H" causes the control block 904 to pause a brief period, such as three to five seconds (step 1308). In step 1310, the control block 904 proceeds with the Telephone Play Logic Sequence as identified in FIG. 53. Upon completion of the Telephone Play Logic Sequence, the control block 904 continues the logic of the Faucet Logic Sequence. The control block 904 randomly selects between two sequence branches as shown in FIG. 50. In the illustrated embodiment, the "I" branch is selected approximately 20% of the time and the "J" branch is selected approximately 40% of the time.

In the "J" branch, the audio output generator 940 generates a spoken sentence or phrase (step 1312). In the illustrated embodiment, the spoken phrase is an instruction to the child to check the cookbook.

Returning to the determination of which mode the kitchen is in (step 1302), the audio transducer 944 produces a sensory audio output from the sensory audio output content 922 (step 1314). The particular sensory output that is generated in this embodiment is the sound of running water. The sensory output is generated for a predetermined amount of time, such as five to ten seconds.

Telephone Logic Sequence

Figure 51:
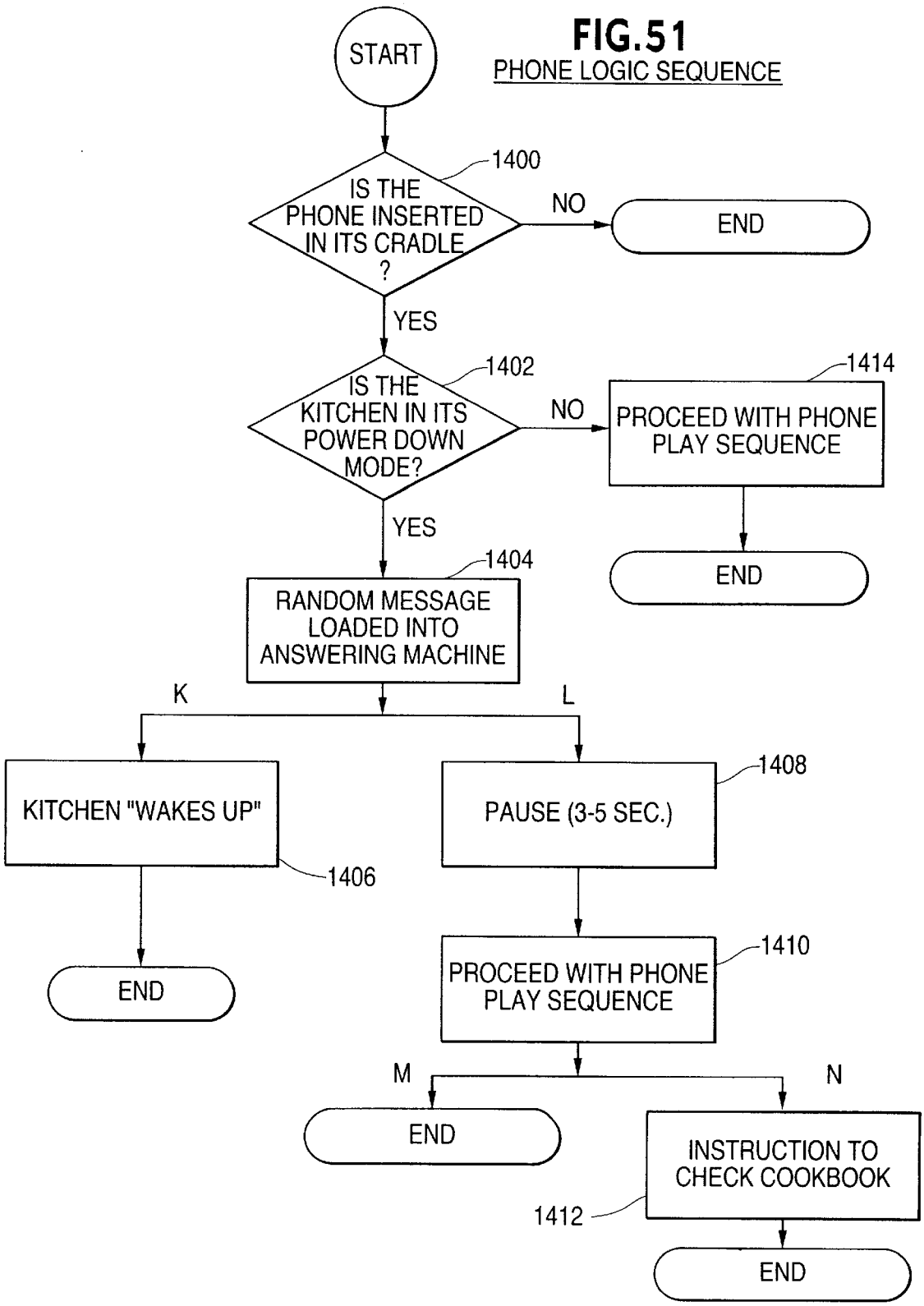
FIG. 51 is a flowchart of the telephone logic sequence of an alternate embodiment in accordance with the principles of the invention.

Turning to the sequence of operation of the kitchen relative to the placement of the telephone in its cradle, the telephone logic sequence is set forth in FIG. 51. The placement of the telephone is discussed with reference to FIGS. 41 and 42.

Figure 42:
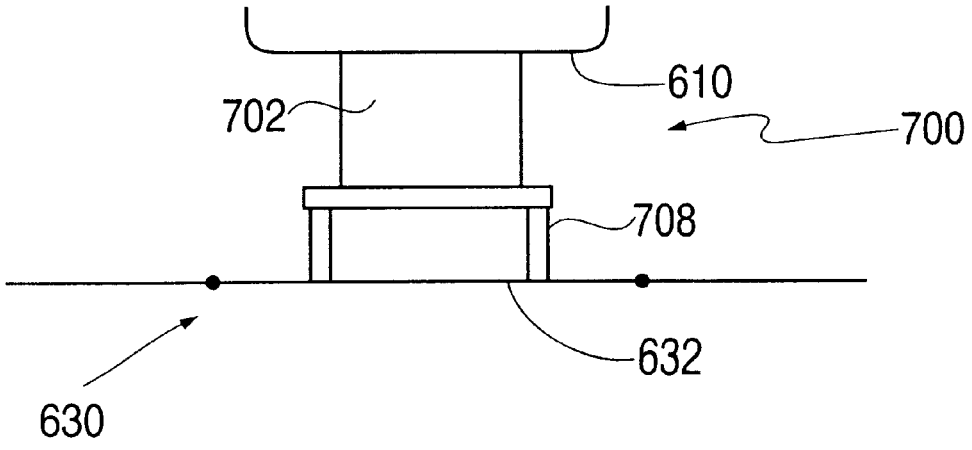
Figure 43:
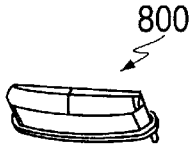
FIG. 43 is a perspective view of the answering machine button of the kitchen of FIG. 1.
Figure 44:
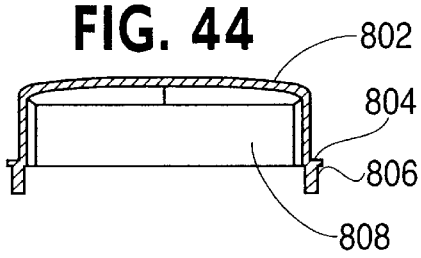
FIG. 44 is a cross-sectional side view of the answering machine button of FIG. 62.

When the telephone 600 is placed.in the cradle 512 in the answering machine 500, the front housing 610 of the telephone 600 contacts the telephone button 700 that is mounted in the answering machine. Legs 708 engage arm 632 of the contact switch 630 as the telephone 600 is pressed into the cradle 512. The arm 632 is moved to close the switch 630 as shown in FIG. 42. The switch 630 generates an input.

In step 1400, the control block 904 determines whether the telephone button input 962 has received a signal from switch 630 and whether such signal was forwarded to the processor 908. If the telephone was not inserted into the cradle, the system remains in its current state.

After an input has been received from the telephone button input 962, the control block 904 determines which mode the kitchen is in from the mode selector 990 (step 1402). If the kitchen is in the power-down mode, a random message in the audio output content 922 is loaded into memory in the control block 904 (step 1404). The control block 904 randomly selects between two sequence branches as shown in FIG. 51. In the illustrated embodiment, the "K" branch is selected approximately 40% of the time and the "L" branch is selected approximately 60% of the time.

In step 1406, the kitchen wakes up from its power-down mode. The control block 904 loads a message into memory, the video output generator 950 produces a signal, and the lamp in the answering machine is illuminated. The logic sequence of branch "K" causes the control block 904 to stop.

The logic sequence of branch "L" causes the control block 904 to pause a brief period, such as three to five seconds (step 1408). In step 1410, the control block 904 proceeds with the Telephone Play Logic Sequence as identified in FIG. 53. Upon completion of the Telephone Play Logic Sequence, the control block 904 continues the logic of the Telephone Button Logic Sequence. The control block 904 randomly selects between two sequence branches as shown in FIG. 51. In the illustrated embodiment, the "M" branch is selected approximately 20% of the time and the "N" branch is selected approximately 40% of the time.

In the "N" branch, the audio output generator 940 generates a spoken sentence or phrase (step 1412). In the illustrated embodiment, the spoken phrase is an instruction to the child to check the cookbook.

Returning to the determination of which mode the kitchen is in (step 1402), the control block 904 proceeds with the Telephone Play Logic Sequence as identified in FIG. 53. Upon completion of the Telephone Play Logic Sequence, the control block 904 stops according to the logic of the Telephone Button Logic Sequence.

Burner Top Logic Sequence

Turning to the sequence of operation of the kitchen relative to the placement of an object on the top of a burner, the burner top logic sequence is set forth in FIG. 52. The placement of an object is discussed with reference to FIGS. 10A and 10B.

When an object, such as a utensil 80, is placed on the top of a burner 210, as shown in FIGS. 10A and 10B, the burner top switch 260 is closed. The arm 262 of the switch is normally in an open position. When an object is placed on the burner, the burner button 294 is pressed down to move the arm 262 to its closed position. When the switch 260 is closed, an input from the burner top input 968 is generated.

In step 1500, the control block 904 determines whether the burner top input 968 has received a signal from switch 260 and whether such signal was forwarded to the processor 908. If no object has been placed on a burner, the system remains in its current state.

After an input has been received from the burner top input 968, the control block 904 determines which mode the kitchen is in from the mode selector 990 (step 1502). If the kitchen is in the power-down mode, a random message in the audio output content 922 is loaded into memory in the control block 904 (step 1504). If the kitchen was not in its power-down mode, then step 1504 is skipped.

In step 1506, the control block 904 reviews the input signal from the cookbook input 970 to determine which side of the cookbook page 300 is not in contact with the base 226 of the cookbook 220.

If the cookbook page 300 is displaying a first side not in contact with the cookbook (step 1508), then the audio output generator 940 generates an audio sensory output signal (step 1510). In the illustrated embodiment, the first side of the cookbook page includes an illustration of spaghetti and the generated audio sensory output signal is the sound of water boiling. Note that the illustration on the cookbook page and the output signal may be changed to any particular food and/or sound.

If the cookbook page 300 is displaying a second side not in contact with the cookbook (step 1512), then the audio output generator 940 generates a different audio sensory output signal (step 1514). In the illustrated embodiment, the second side of the cookbook page includes an illustration of breakfast foods and the generated audio sensory output signal is the sound of food frying.

Each of the audio sensory output signal is generated for a predetermined amount of time, such as five to ten seconds.

If the cookbook page is positioned such that neither side of the page contacts the cookbook, then the controller 902 awaits a user input and powersdown after a predetermined amount of time (step 1516).

Telephone Play Sequence

Turning to the sequence of operation of the kitchen, the telephone play sequence is set forth in FIG. 53.

In step 1600, the audio output generator 940 generates an audio output signal. The audio output signal is the ring of a telephone and the generator 940 generates three rings. In step 1602, the control block 904 determines whether an input signal has been received from the telephone button input 962 that is indicative of whether the telephone 600 has been removed from the cradle to "answer" the call. When the telephone 600 is removed from the cradle 512, the front housing 610 is not in contact with the telephone button 700 and the switch 630 is opened. When the switch 630 is opened, there is no signal from the telephone button input 962.

If the telephone 600 was picked up by a user during the initial three rings, the audio sensory output generator 940 generates an output from a series of audio output content 922. The audio input content 922 is a spoken series of sentences or phrases. In the illustrated embodiment, the content includes script with a phrase and a closing statement, which is a statement that concludes a conversation. The script is randomly generated from a series of conversational sentences and phrases that are stored in the audio sensory output content 922. The audio output is emitted through the speaker in the answering machine. When the audio transducer 944 has played the audio output, the controller 902 stops.

If the telephone 600 was not picked up by a user during the initial three rings, the audio sensory output generator 940 generates an audio output that is played by the audio transducer 944 (step 1604). This audio output is typically one or more sentences that is a simulated message on an answering machine.

Similar to step 1602, the control block 904 determines whether an input signal has been received from the telephone button input 962 that is indicative of whether the telephone 600 has been removed from the cradle during the playing of the simulated message (step 1606). When the telephone 600 is removed from the cradle 512, the front housing 610 is not in contact with the telephone button 700 and the switch 630 is opened. When the switch 630 is opened, there is no signal from the telephone button input 962.

If the telephone 600 was not picked up by a user during the playing of the message, then the controller 902 stops and awaits another input from the input block 980.

If the telephone 600 was picked up by a user, then the audio sensory output generator 940 generates an audio output that is played by the audio transducer 944 (steps 1608 and 1610). This audio output is typically one or more sentences and a closing statement (such as "Cooking is fun", "Bye, bye", and "Remember to hang up the phone"). The controller 902 then stops and awaits another input from the input block 980.

Answering Machine Logic Sequence

Turning to the sequence of operation of the kitchen relative to the answering machine, the telephone logic sequence is set forth in FIG. 54. The operation of the answering machine button is discussed with reference to FIGS. 45 and 46.

When the user presses the answering machine button 800, the legs 806 of the button 800 contact the answering machine switch 550 as shown in FIG. 46. Legs 806 engage arm 552 of the contact switch 550 as the button 800 is pressed. The arm 552 is moved to close the switch 550 as shown in FIG. 46. The switch 550 generates an input signal.

In step 1700, the control block 904 determines whether the answering machine input 960 has received a signal from switch 550 and whether such signal was forwarded to the processor 908. If the button was not pressed, the system remains in its current state.

After an input has been received from the answering machine input 960, the control block 904 determines whether the audio output generator 940 is generating an audio signal corresponding to the ring of a telephone (step 1702). If such an audio signal is being generated, the video output generator 950 generates a video output signal. The video output signal is transmitted to the video transducer, which in this case is the lamp beneath the transparent answering machine button. The video output signal is an intermittent signal that simulates flashing at a frequency that is substantially equivalent to the frequency of the telephone rings (step 1716).

In step 1718, the audio output generator 940 generates an audio output signal. The audio signal is a spoken script of sentences or phrases. In the illustrated embodiment, the sentences or phrases are representative of a telephone conversation (such as "Do you know where the forks go?" and "Cooking is fun.").

Next, the control block 904 determines which mode the kitchen is in from the mode selector 990 (step 1704). If the kitchen is in the power-down mode, the audio output generator 940 generates an audio signal indicative of a telephone message (step 1706) and a random message in the audio output content 922 is loaded into memory in the control block 904 (step 1707).

In step 1708, the video output generator 950 generates a video output that is emitted from a video transducer 954, such as the lamp beneath the answering machine button. The video output is at a different frequency than the video output generated for step 1716 as discussed above. The frequency may be more than or less than the frequency of the ringing above.

In step 1710, the control block 904 determines whether the answering machine input 960 has received a signal from switch 550 and whether such signal was forwarded to the processor 908. If the button was not pressed, the answering machine lamp continues to flash.

If the answering machine button was pressed, then the audio content that was loaded into memory during step 1707 is transmitted to the audio transducer 944 which plays the audio content. A different, random message in the audio output content 922 is loaded into memory in the control block 904 (step 1714). The controller 902 awaits the next user input and powers-down if a predetermined period of time passes without an input.

Figure 55:
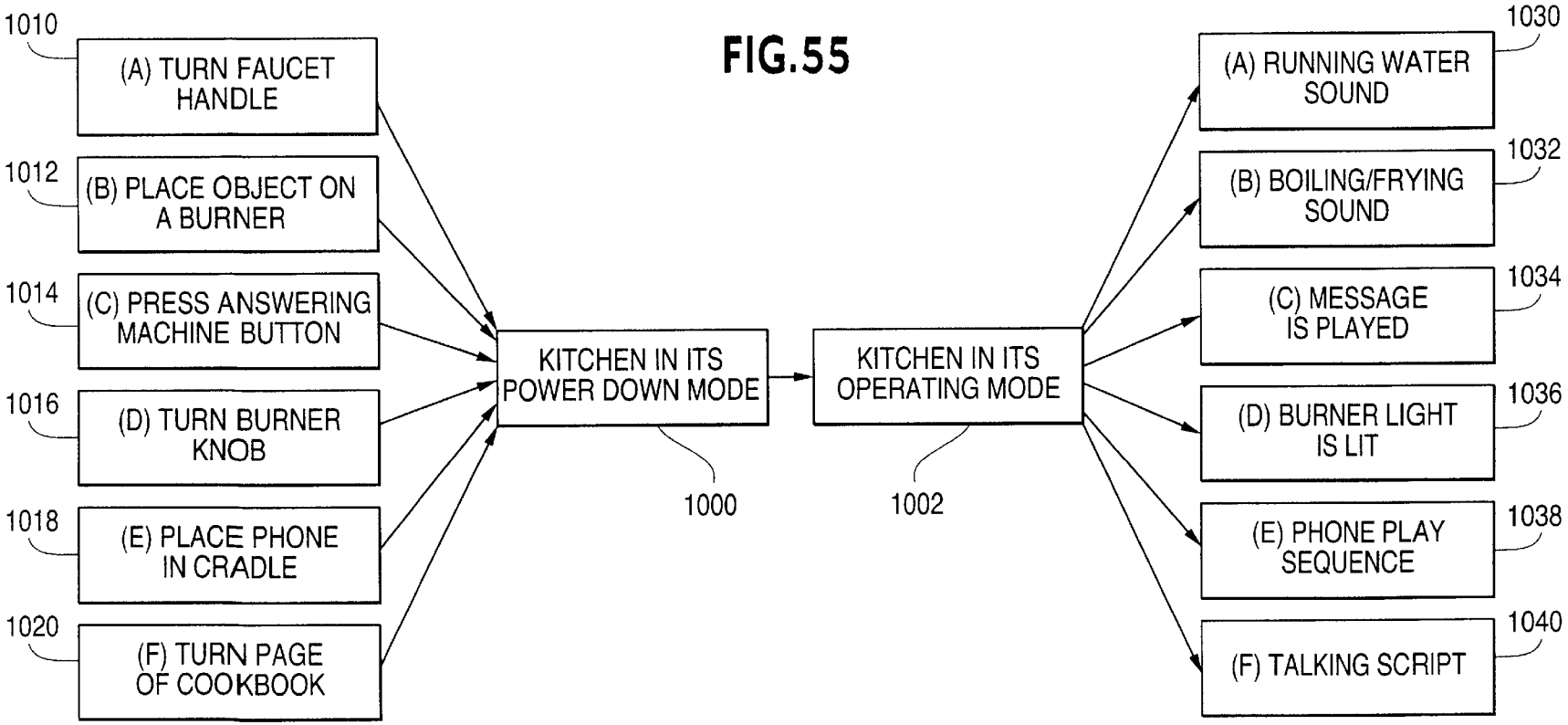
FIG. 55 is a schematic of the inputs and sensory outputs related to the kitchen in its power down and operating modes.

Turning to FIG. 55, a simplified schematic of the relative effect of an input on the mode of the kitchen is shown. Examples of some of the user actions 1010, 1012, 1014, 1016, 1018, 1020 that are related to the inputs in the illustrated embodiment are shown. The outputs that correspond to the user actions are shown with the corresponding letter, for example, the activity (A) turn faucet handle corresponds to the output (A) sound of running water. The inputs are the actions that "wake-up" the kitchen from its power-down state 1000. The mode of the kitchen is changed to its operating mode 1002.

The outputs 1030, 1032, 1034, 1036, 1038, and 1040 are examples of the audio and video sensory outputs that were described in reference to the logic sequences.

An alternate and preferred embodiment of the invention will now be described in reference to FIGS. 56 through 62. Only the differences between this embodiment and the embodiment previously described will be discussed.

Cookbook Logic Sequence

Figure 56:
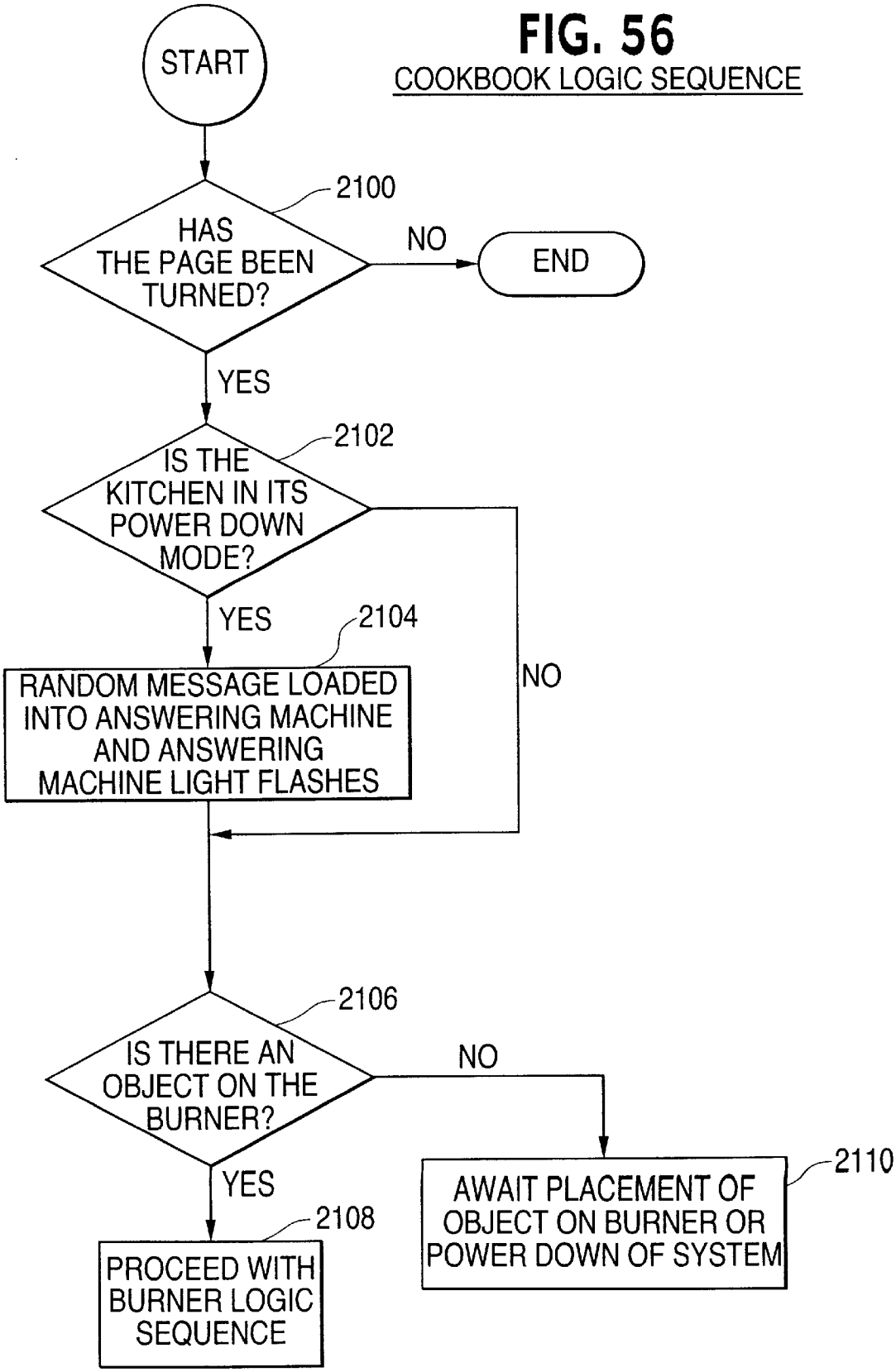
FIG. 56 is a flowchart of the cookbook logic sequence of a preferred embodiment in accordance with the principles of the invention.

Turning to the sequence of operation of the kitchen relative to the cookbook, the cookbook logic sequence is set forth in FIG. 56. In this embodiment, the control block 904 does not select between two sequence branches as shown in FIG. 48. Also, the audio transducer 944 does not produce an output of speech as performed in steps 1106, 1108, 1110 in FIG. 48.

Burner Knob Logic Sequence

Figure 57:
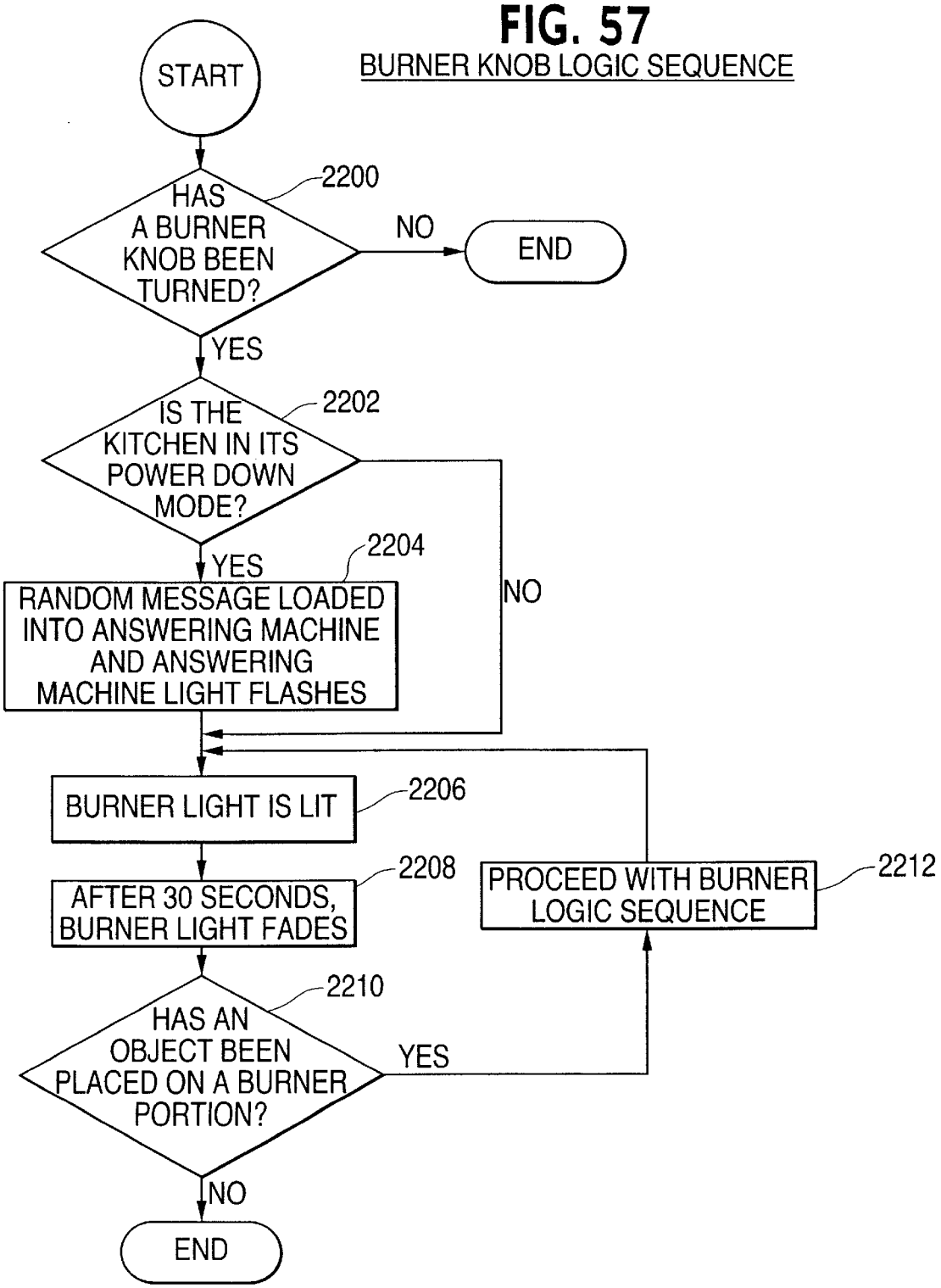
FIG. 57 is a flowchart of the burner knob logic sequence of a preferred embodiment in accordance with the principles of the invention.

Turning to the sequence of operation of the kitchen relative to the burner knobs or dials, the burner knob logic sequence is set forth in FIG. 57. In this embodiment, the control block 904 does not select between two sequence branches as shown in FIG. 49. In step 2210, the control block 904 determines whether an object has been placed on a burner portion. If no object is present, then the burner light is turned off. However, if an object is present, then the control block 904 proceeds with the Burner Logic Sequence in FIG. 60 (step 2212).

Faucet Logic Sequence

Figure 59:
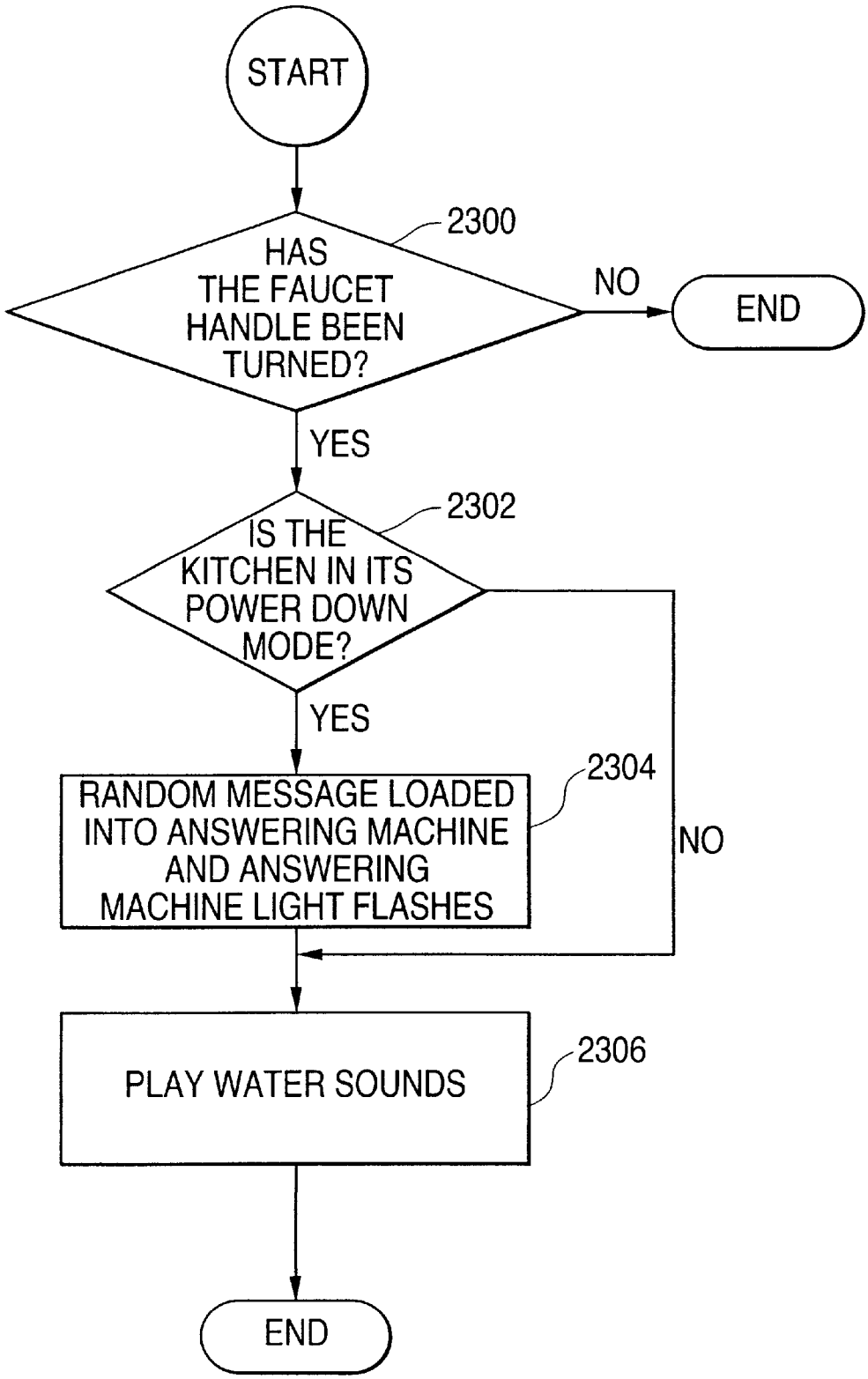
FIG. 59 is a flowchart of the telephone logic sequence of a preferred embodiment in accordance with the principles of the invention.

Turning to the sequence of operation of the kitchen relative to the faucet handle, the faucet logic sequence is set forth in FIG. 59. In this embodiment, the control block 904 does not select between two sequence branches as shown in FIG. 50.

Telephone Logic Sequence

Figure 58:
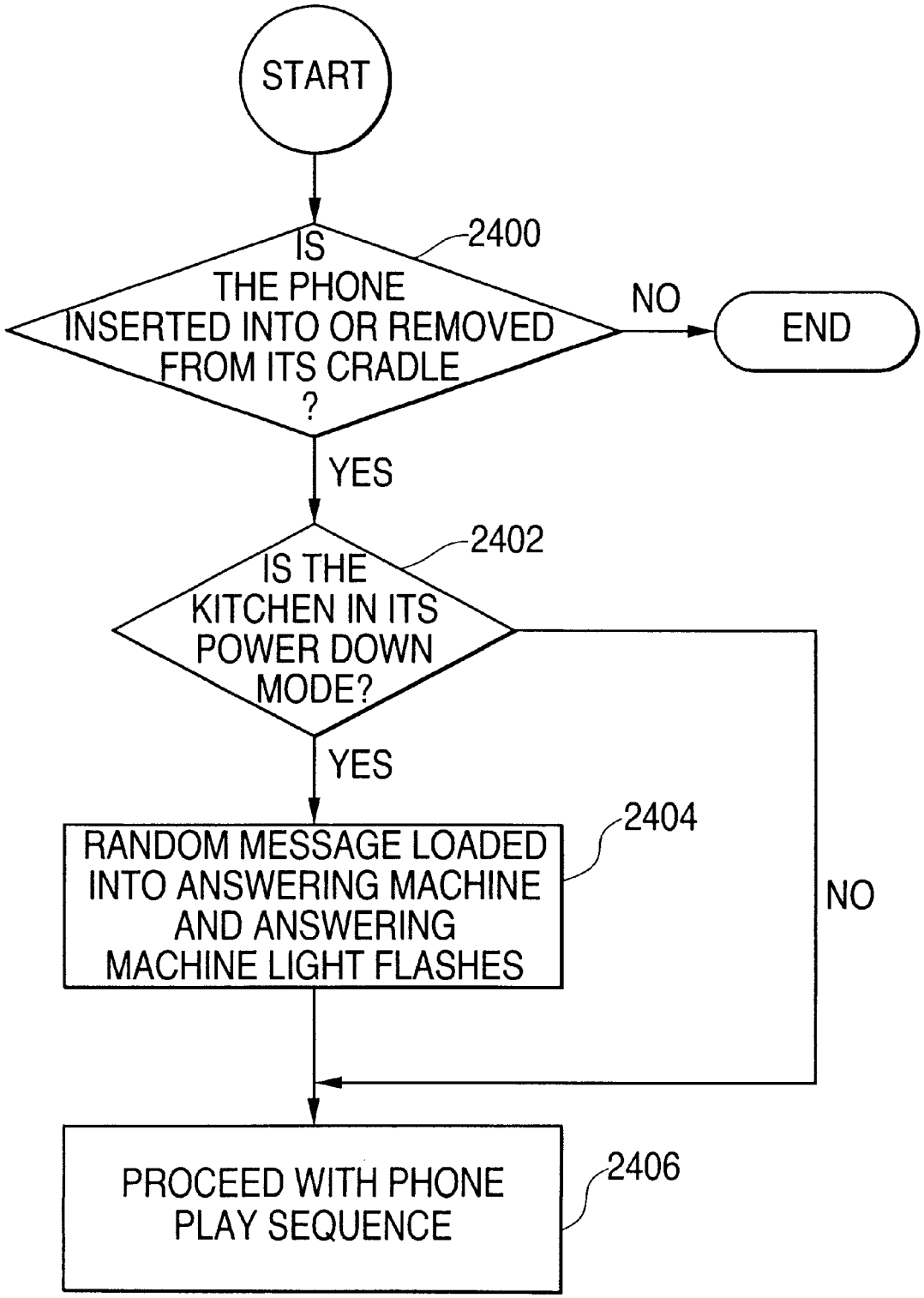
FIG. 58 is a flowchart of the faucet logic sequence of a preferred embodiment in accordance with the principles of the invention.

Turning to the sequence of operation of the kitchen relative to the placement of or removal of the telephone from its cradle, the telephone logic sequence is set forth in FIG. 58. The placement of the telephone is discussed with reference to FIGS. 41 and 42. In this embodiment, the control block 904 does not select between two branch sequences as shown in FIG. 51.

Burner Logic Sequence

Turning to the sequence of operation of the kitchen relative to the placement of an object on the top of a burner, the burner top logic sequence is set forth in FIG. 60. The placement of an object is discussed with reference to FIGS. 10A and 10B.

After an input has been received from the burner top input 968, the control block 904 determines which mode the kitchen is in from the mode selector 990 (step 2502). If the kitchen is in the power-down mode, a random message in the audio output content 922 is loaded into memory in the control block 904 (step 2504) and audio output resembling a telephone conversation is generated (step 2506). If the kitchen was not in its power-down mode, then step 2504 is skipped.

In step 2508, the control block 904 determines whether the burner light is lit. If the light is not on, then no audio output is generated. If the burner light is on, then the control block determines which pages of the cookbook is selected (step 2510).

The other change from the embodiment in FIG. 52 is that the control block 904 determines whether the object has been removed from the burner portion (step 2522) while the audio output of steps 2518 or 2520 is playing. If the object has been removed, then the audio output is stopped (step 2524), the burner light is lit (step 2526) and after thirty seconds, the light fades if no object is placed on the burner (step 2528).

Telephone Play Sequence

Figure 61:
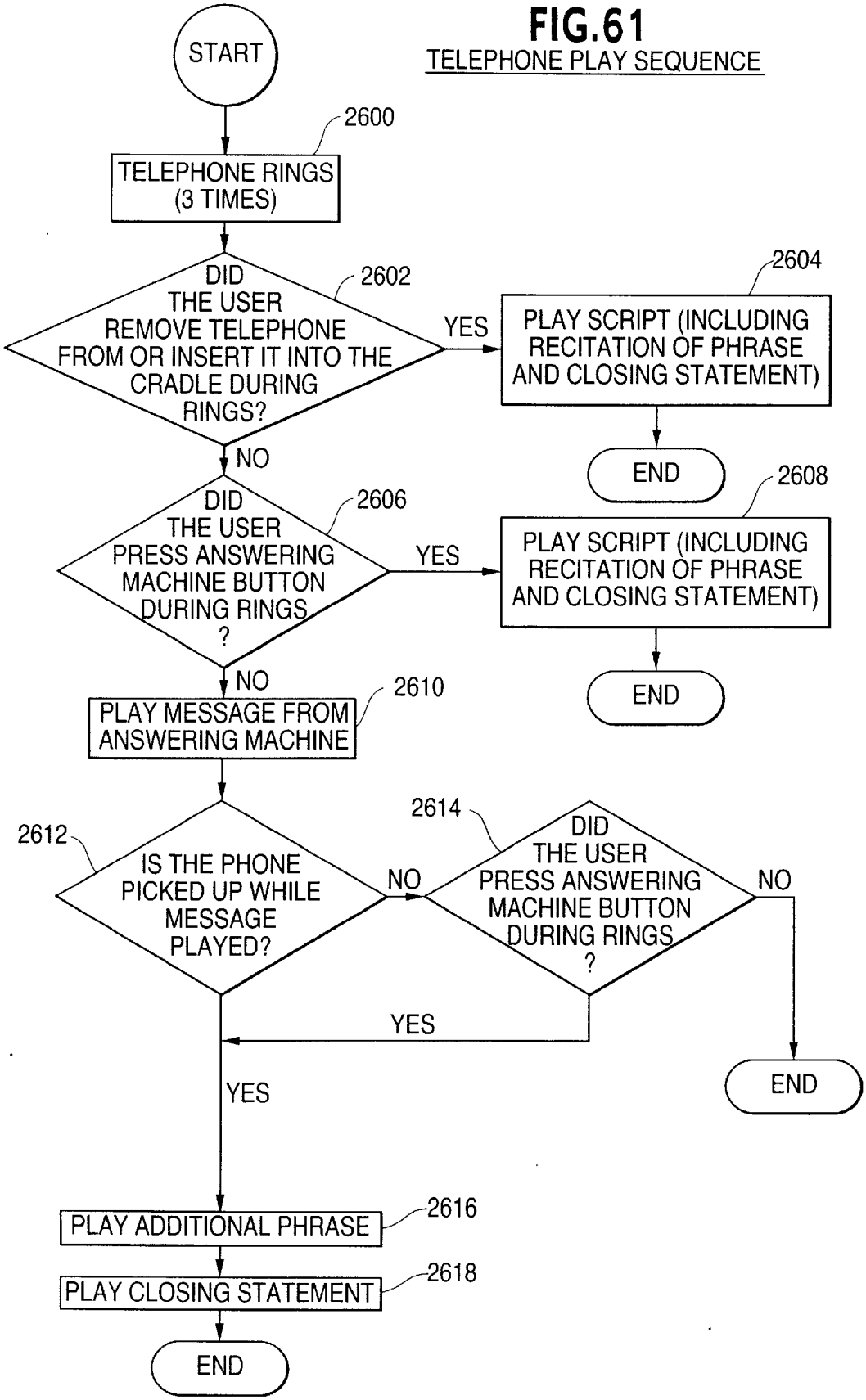
FIG. 61 is a flowchart of the telephone play logic sequence of a preferred embodiment in accordance with the principles of the invention.

Turning to the sequence of operation of the kitchen, the telephone play sequence is set forth in FIG. 61. In this embodiment, the control block 904 determines whether the user has inserted or removed the telephone from its cradle (step 2602) or whether the user has pressed the answering machine button (step 2606) while the telephone rings were generated. If the user has performed either step, an audio output, such as speech, is generated and played (steps 2604, 2608).

When an audio output resembling an answering machine message is played (step 2612), then the control block 904 determines whether the user inserted or removed the telephone (step 2612) or pressed the answering machine button (step 2614) while the message is played. In order to answer a call (while the telephone is ringing), the user may press the answering machine button if the telephone is not present.

Answering Machine Logic Sequence

Turning to the sequence of operation of the kitchen relative to the answering machine, the telephone logic sequence is set forth in FIG. 62. The operation of the answering machine button is discussed with reference to FIGS. 45 and 46. In this embodiment, the only difference is the step 2700 which confirms whether a message is loaded in the machine.

As the artisan will appreciate, there are many possible variations on the embodiment of the toy kitchen 10 described above that would be consistent with the principles of the invention. Some of the variations are identified below.

In the illustrated embodiment, the various kitchen components are formed of plastic materials, but may be any other material suitable for use.

The shelf, legs, countertop, and lower portion may be coupled together by plastic pins or bolts instead of the snap fit connections.

The switches in the kitchen may be activated magnetically rather than by contact or displacement.

The power supply is disclosed as batteries, but it is contemplated that alternative sources of power could be used, including household AC power.

The illustrations on the cookbook base and page may be any design, not necessarily the those described above.

The audio content stored in the main controller unit may be any speech or sounds. The sentences and phrases may vary from instructional to conversational, for example.

The types of input mechanisms for receiving and/or sensing a user input may be switches, an electrically woven fabric, or use fiber optics.

I claim:

1. A method of generating a sensory output from a toy kitchen including a countertop with a means for generating an input and a page mounted thereto, the page having first and second surfaces, the method comprising the steps of:

moving the page to position the first surface of the page into selective contact with the input means to generate a first input;

receiving and processing said first input; and generating a first sensory output in response to said first input.

2. The method of claim 1 further comprising the steps of:

moving the page to position the second surface of the page into selective contact with the input means to generate a second input;

receiving and processing said second input;

generating a second sensory output in response to said second input, said second sensory output being different from said first sensory output.

3. The method of claim 1 wherein said first sensory output corresponds to a first indicium represented on said page that is displayed when the first surface is in selective contact with the input means.

4. The method of claim 3 wherein said first indicium represents a food that is cooked by frying and wherein said first sensory output is a frying sound.

5. The method of claim 2 wherein said second sensory output corresponds to a second indicium represented on said page that is displayed when the second surface is in selective contact with the input means.

6. The method of claim 5 wherein said second indicium represents a food that is cooked by boiling and wherein said second sensory output is a boiling water sound.

* * * * *